US012635751B2

(12) United States Patent
Campbell et al.

(10) Patent No.: US 12,635,751 B2
(45) Date of Patent: May 26, 2026

(54) MOLDED BASEBALL CAP

(71) Applicant: Under Armour, Inc., Baltimore, MD (US)

(72) Inventors: Derek Campbell, Baltimore, MD (US); Seden Craig, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 19/066,780

(22) Filed: Feb. 28, 2025

(65) Prior Publication Data

US 2025/0275599 A1 Sep. 4, 2025

Related U.S. Application Data

(60) Provisional application No. 63/559,244, filed on Feb. 29, 2024.

(51) Int. Cl.
*A42B 1/02* (2006.01)
*A42B 1/019* (2021.01)

(52) U.S. Cl.
CPC ..... *A42B 1/02* (2013.01); *A42B 1/019* (2021.01)

(58) Field of Classification Search
CPC .... A42B 1/02; A42B 1/019; B29L 2031/4814
See application file for complete search history.

(56) References Cited

U.S. PATENT DOCUMENTS 1,303,992 A * 5/1919 Tofias ..... A42C 1/04 223/12
2,111,212 A * 3/1938 Hawley ..... A42C 1/04 223/7
3,673,611 A 7/1972 Cain et al.
5,112,667 A * 5/1992 Li ..... F41H 5/0485 428/113

(Continued)

FOREIGN PATENT DOCUMENTS

CN 105747343 A 7/2016
EP 3430930 A1 1/2019

(Continued)

OTHER PUBLICATIONS

International Search Report and Written Opinion in counterpart International Application No. PCT/US2025/017818, mailed Oct. 18, 2025, 11 pages.

*Primary Examiner* — Alissa L Hoey
*Assistant Examiner* — Akwokwo Olabisi Redhead
(74) *Attorney, Agent, or Firm* — Edell, Shapiro & Finnan, LLC

(57) ABSTRACT

An article of headwear includes a crown portion dimensioned to cover a portion of a forehead of a wearer when the article of headwear is worn by the wearer, and a brim that extends transversely from the crown. The crown and brim are formed of a single unitary molded body including an upper fabric layer, a lower fabric layer that faces toward the head of the wearer, and an intermediate layer disposed between the upper fabric layer and the lower fabric layer, (Continued)

and each of the upper fabric layer, the lower fabric layer and the intermediate layer continuously extends between the crown and the brim. A transition angle is defined at a transition between the brim and the crown, wherein the transition angle is obtuse.

19 Claims, 28 Drawing Sheets

(56) References Cited

U.S. PATENT DOCUMENTS

| | | | | |
|---|---|---|---|---|
| 6,138,279 | A * | 10/2000 | Gore | A42C 1/06 2/195.6 |
| 6,158,053 | A | 12/2000 | Wang | |
| 7,081,218 | B2 * | 7/2006 | Sekido | B29C 70/48 264/40.1 |
| 9,420,839 | B2 | 8/2016 | Shirai | |
| 10,010,128 | B2 | 7/2018 | Zhang | |
| 10,226,884 | B2 | 3/2019 | Chan | |
| 10,314,358 | B1 | 6/2019 | Mao | |
| 10,624,409 | B2 | 4/2020 | Chan | |
| 10,694,800 | B2 | 6/2020 | Lau | |
| 10,765,162 | B2 | 9/2020 | Mao | |
| 2004/0006810 | A1 * | 1/2004 | Park | A42B 1/0182 2/209.12 |
| 2004/0123376 | A1 | 7/2004 | Wang | |
| 2006/0179543 | A1 * | 8/2006 | Burmester | A42B 1/02 2/171 |
| 2009/0199320 | A1 | 8/2009 | Ng | |
| 2015/0096104 | A1 | 4/2015 | Kim | |
| 2015/0237942 | A1 * | 8/2015 | Arkusz | A42B 3/28 2/195.1 |
| 2018/0303183 | A1 | 10/2018 | Brandt et al. | |
| 2019/0183204 | A1 | 6/2019 | Mao | |
| 2019/0274387 | A1 | 9/2019 | Mao | |
| 2020/0397084 | A1 * | 12/2020 | Henning | A42B 1/206 |
| 2021/0289877 | A1 | 9/2021 | Zhang | |
| 2022/0184896 | A1 * | 6/2022 | Hwang | B29D 99/0064 |

FOREIGN PATENT DOCUMENTS

| | | | | |
|---|---|---|---|---|
| JP | H10280222 | A | 10/1998 | |
| JP | 3215564 | U | 3/2018 | |
| WO | 2004026060 | A2 | 4/2004 | |
| WO | WO-2021011373 | A1 * | 1/2021 | A41B 1/08 |

* cited by examiner

MOLDED BASEBALL CAP

CROSS-REFERENCE TO RELATED APPLICATION

This application claims priority from U.S. Provisional Patent Application No. 63/559,244, filed Feb. 29, 2024, the entire disclosure of which is incorporated herein by reference.

FIELD OF THE INVENTION

The present invention relates to an article of headwear, e.g., a cap with crown portion and brim.

BACKGROUND

Headwear including a crown portion and brim, such as a visor with partial crown or a cap (e.g., baseball cap) with complete crown and brim, are typically used for leisure, recreational and/or athletic activities to provide comfort to a wearer's head against the elements (e.g., sun, wind, rain, etc.) and shield the wearer's eyes from the sun during use. Standard headwear typically has a number of seams to connect components such as the brim and sweatband to the crown or cap, where the cap is formed by panels also connected with a number of seams. The seams can create a number of hard edges that rest against the wearer's head and can cause discomfort when worn.

Conventional visored or baseball-style caps include a hemispherical crown portion to fit onto a wearer's head and a visor or bill portion attached to the front of the hemispherical crown portion. Several substantially triangular panels called gores are joined together with seams to form the crown. Typically, a baseball cap has six gores, which are sewn together to form the rounded shape of the crown. The visor is formed of a rigid cardboard or plastic and is attached to the forward portion of the lower peripheral edge.

In addition, the visor or brim of the cap is typically connected at a sharp right angle with the cap and can include many folded layers as the connection which create further hard edges of contact with the forehead of the wearer during use of the cap. In addition, forehead shapes can vary from narrow to wide foreheads, resulting in different pressure points of the cap with visor along the front sides and/or the center of the wearer's forehead since caps typically are formed with a standard configuration to fit a variety of heads. These pressure points can cause marks along the forehead and fatigue by the wearer.

It would be desirable to provide headwear with a visor that is comfortable to wear and minimizes pressure points of contact along the forehead of the wearer regardless of forehead shape (narrow to wide).

SUMMARY OF THE INVENTION

An article of headwear includes a unitary molded structure. In example embodiments, the single unitary molded body is formed from a textile package including an outer or upper fabric layer, an inner or lower fabric layer, and one or more intermediate foam layers of selected durometers disposed between the upper fabric layer and the lower fabric layer. Additional functional layers may be incorporated into the package. The package is shaped via a single step molding process utilizing heat and pressure, thereby forming the unitary molded body or structure. In specific embodiments, the headwear may be a baseball cap including a closed crown and a brim or a tennis visor comprising an open crown and brim.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1A:
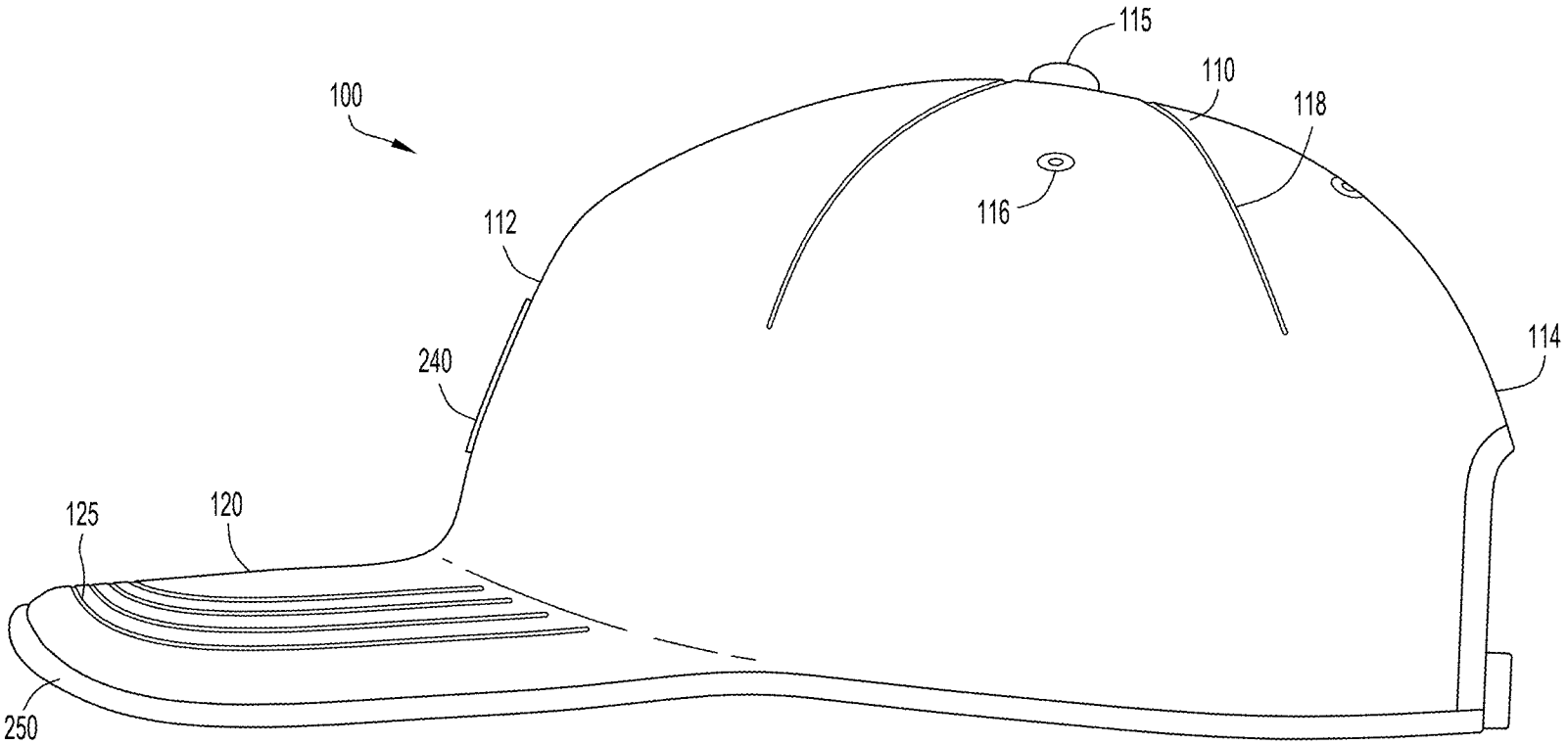
FIG. 1A is a side view of a unibody or unitary article of headwear in the form of a cap in accordance with embodiments described herein.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

A unibody or unitary headwear comprising a crown portion and brim is described herein, in which the crown portion of the headwear and the brim of the headwear are formed as a single, unitary member or structure. The unitary headwear may be formed of material capable of forming the contours of the headwear as well as any structures located on internal and/or external surfaces of the headwear. In an embodiment, the material is a thermoformable, textile laminate (also referred to herein as a fabric laminate) comprising a plurality of layers including one or more fabric (textile) layers, one or more foam layers, and optionally one or more structural support layers disposed internally within the headwear (i.e., located between two or more layers within the plurality of layers forming the headwear), where the fabric laminate is capable of being shaped via compression molding.

In example embodiments, the crown portion and the brim comprise a plurality of layers (e.g., a first or upper fabric layer, an intermediate layer, and a second or lower fabric layer), where the plurality of layers are combined in a molding process and form the unitary molded member or structure that defines the entirety of the brim and at least a crown portion that extends at an obtuse angle from the brim and is suitably dimensioned to cover at least a portion of the forehead of a wearer of the headwear.

The layers that form the unitary molded member of the article of headwear extend continuously from the brim, around a transition region between brim and crown portion, to the crown portion. The crown portion can comprise a full crown portion having a dome shaped member that is dimensioned to cover the top or apex of the head of a wearer (i.e., the crown of the wearer's head). Alternatively, the crown portion may be an open crown that covers only a portion of the wearer's head (e.g., not the top or apex of the wearer's head) including a front or forehead portion of the wearer's head.

Figure 10A:
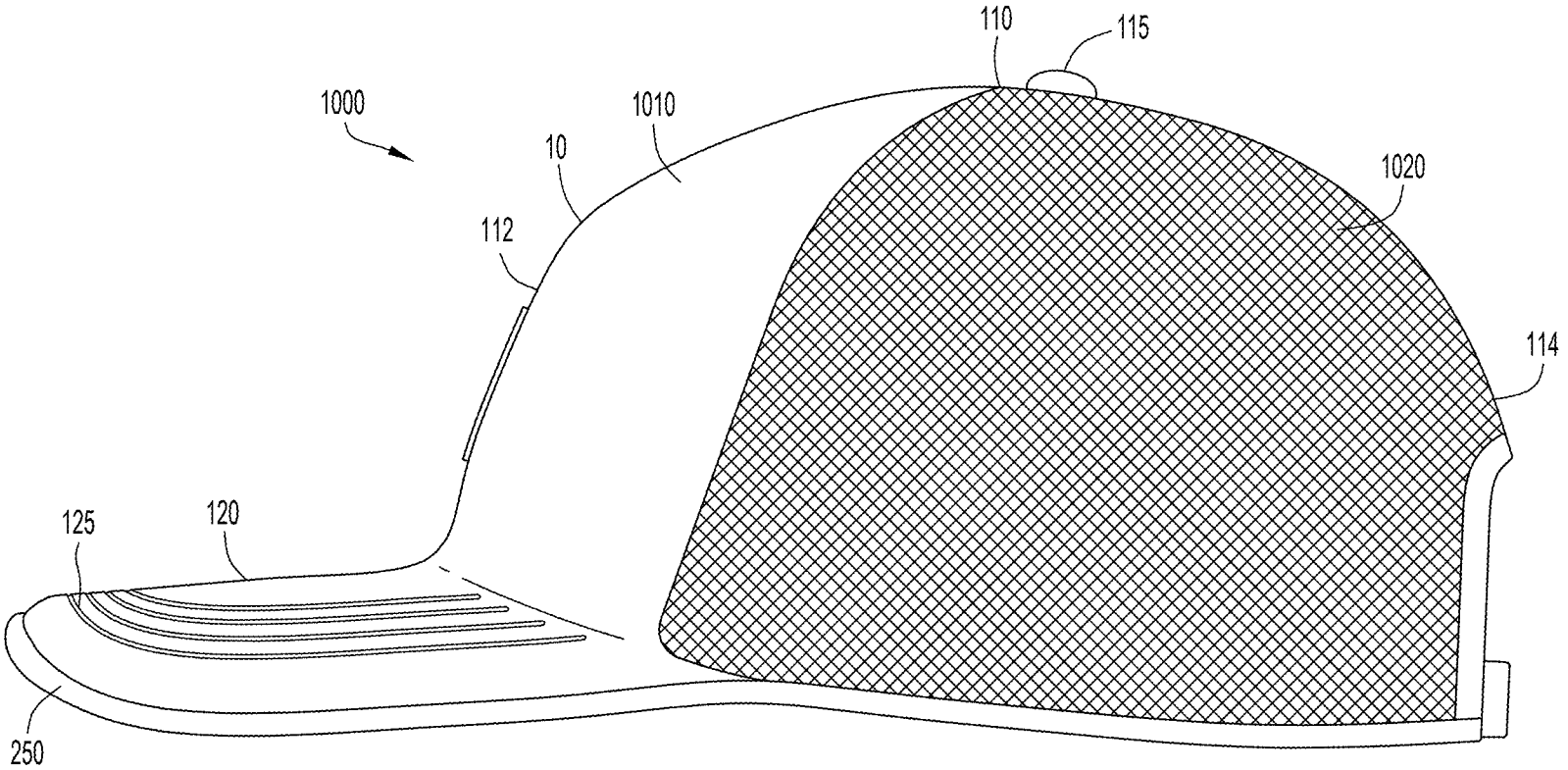
FIG. 10A is a side view of another embodiment of an article of headwear in the form of a cap including a unitary molded member that includes the brim and a first portion of the crown and a second molded member that forms a second portion of the crown and is secured to the first portion.
Figure 10B:
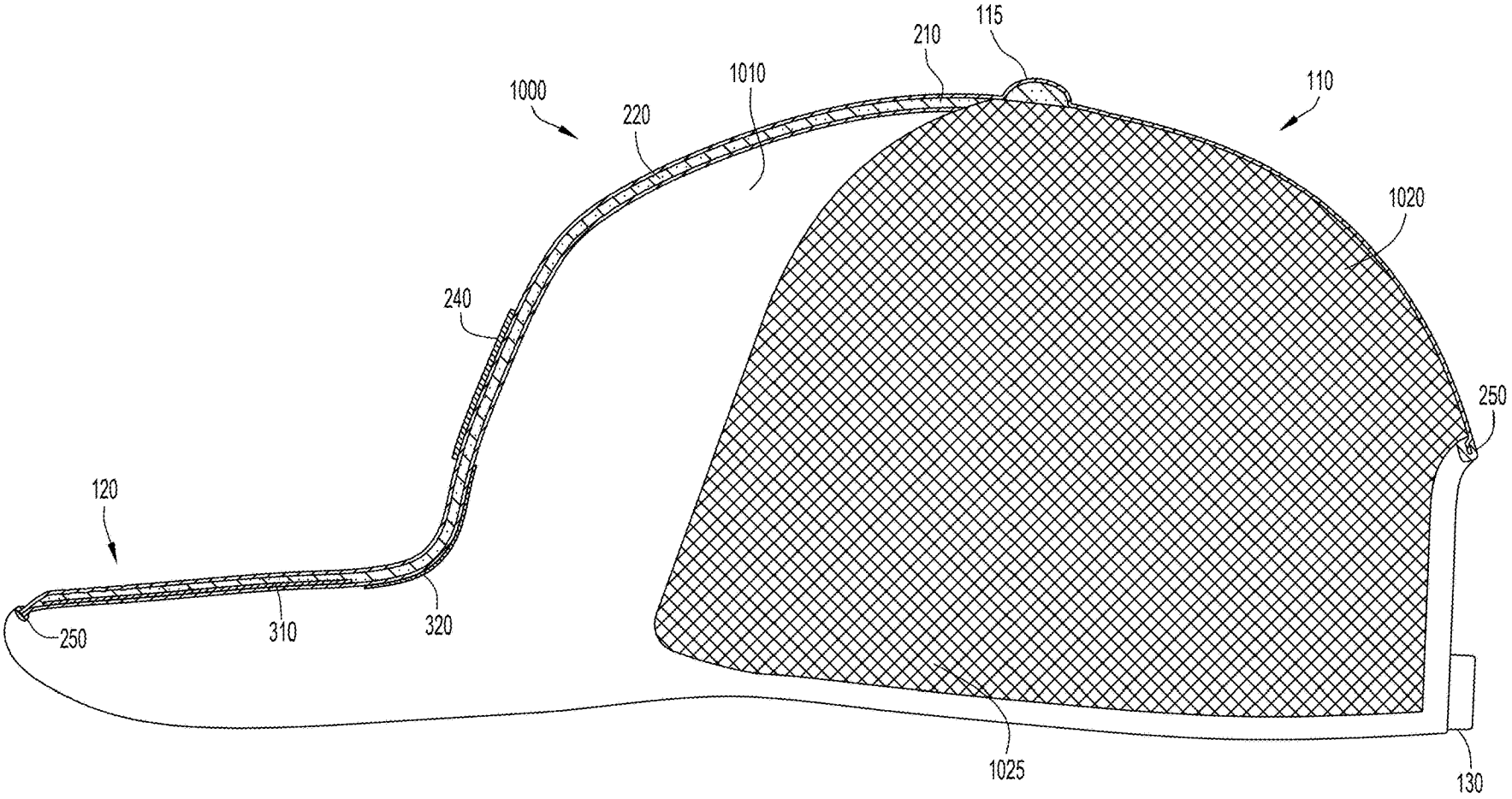
FIG. 10B is a cross-sectional side view of the article of headwear of FIG. 10A.
Figure 12A:
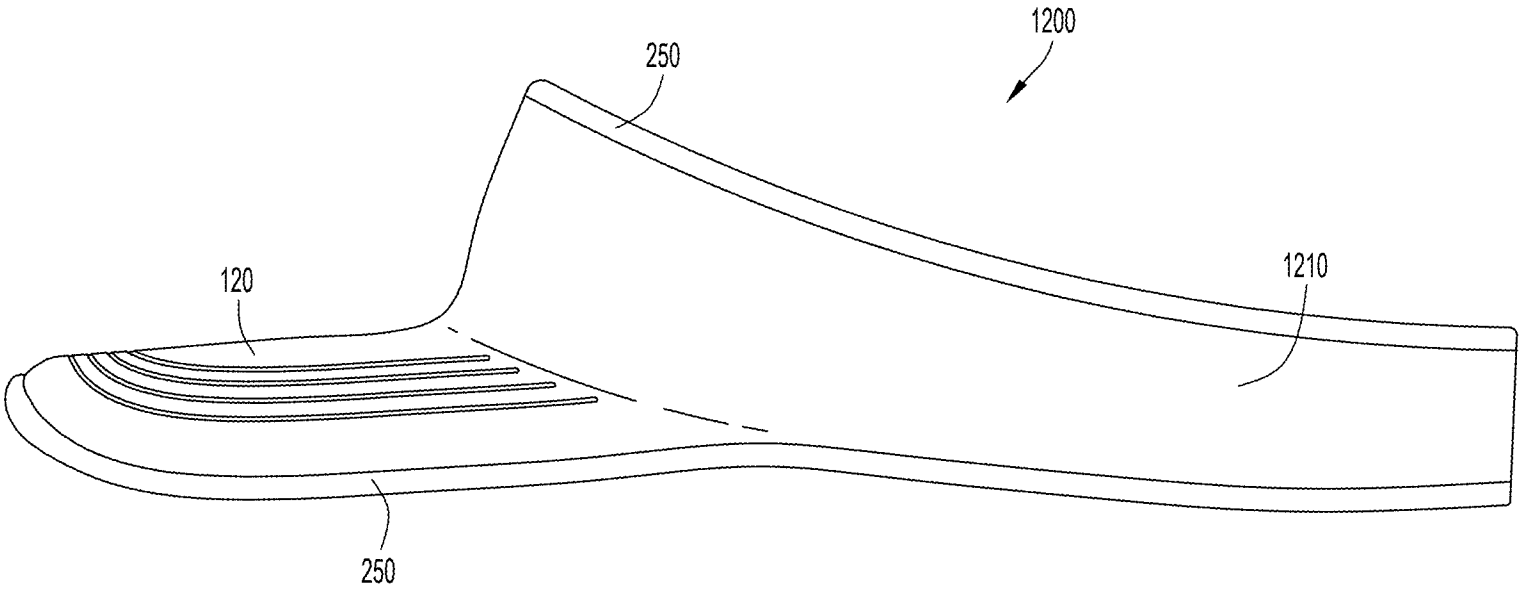
FIG. 12A is a side view of a further embodiment of an article of headwear in the form of a visor.
Figure 12B:
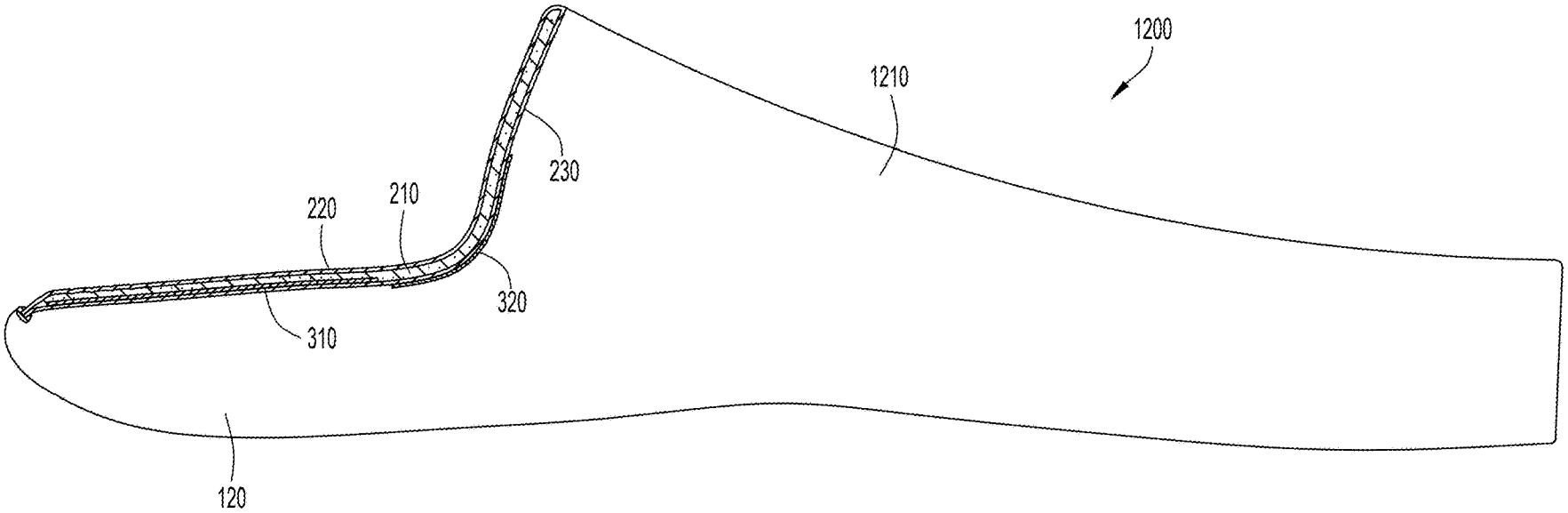
FIG. 12B is a cross-sectional side view of the visor of FIG. 12A.
Figure 13A:
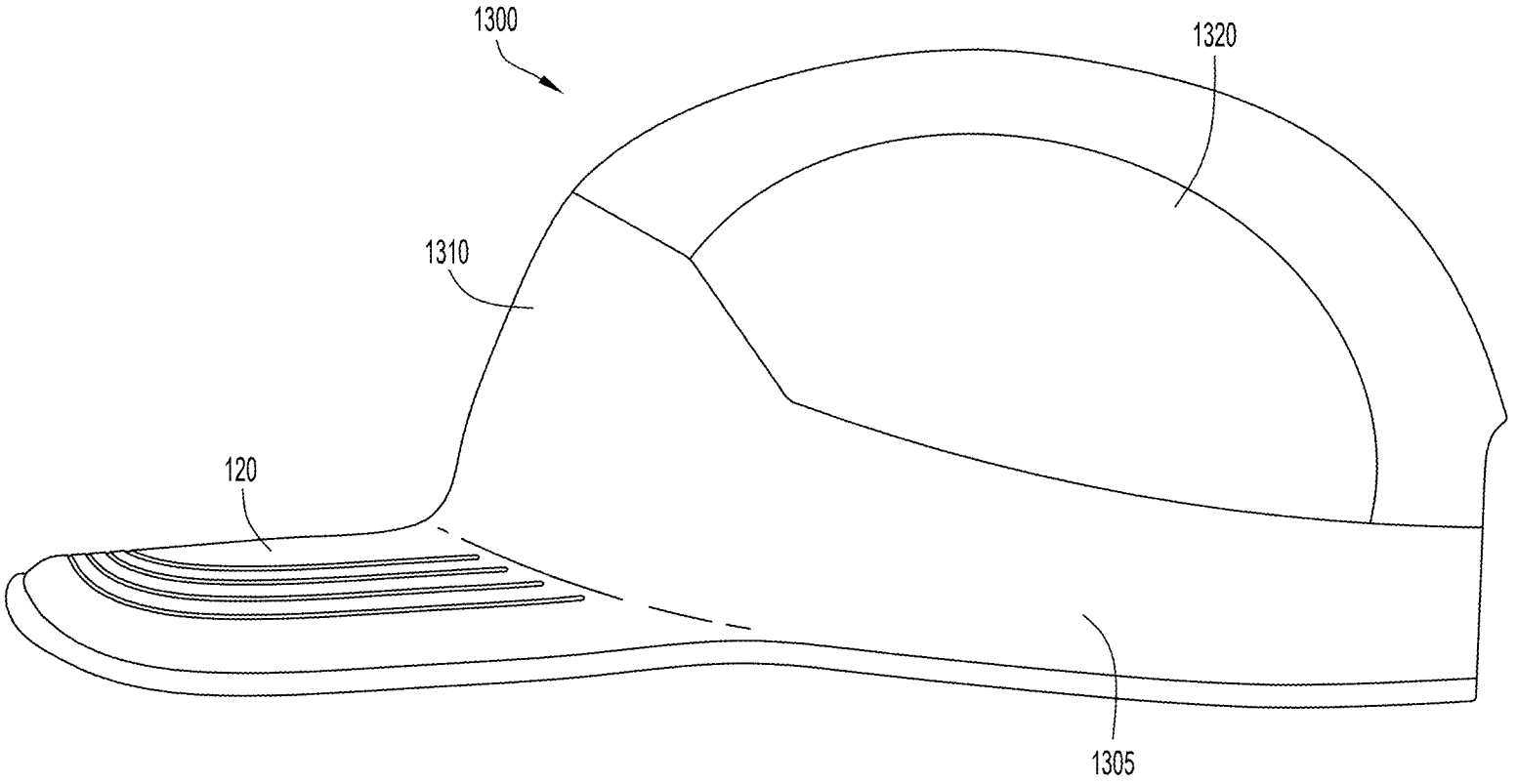
FIG. 13A is a side view of another embodiment of an article of headwear in the form of a cap including a molded unitary first portion and a second portion comprising a plurality of pieces or parts that combine to form the second portion.
Figure 13B:
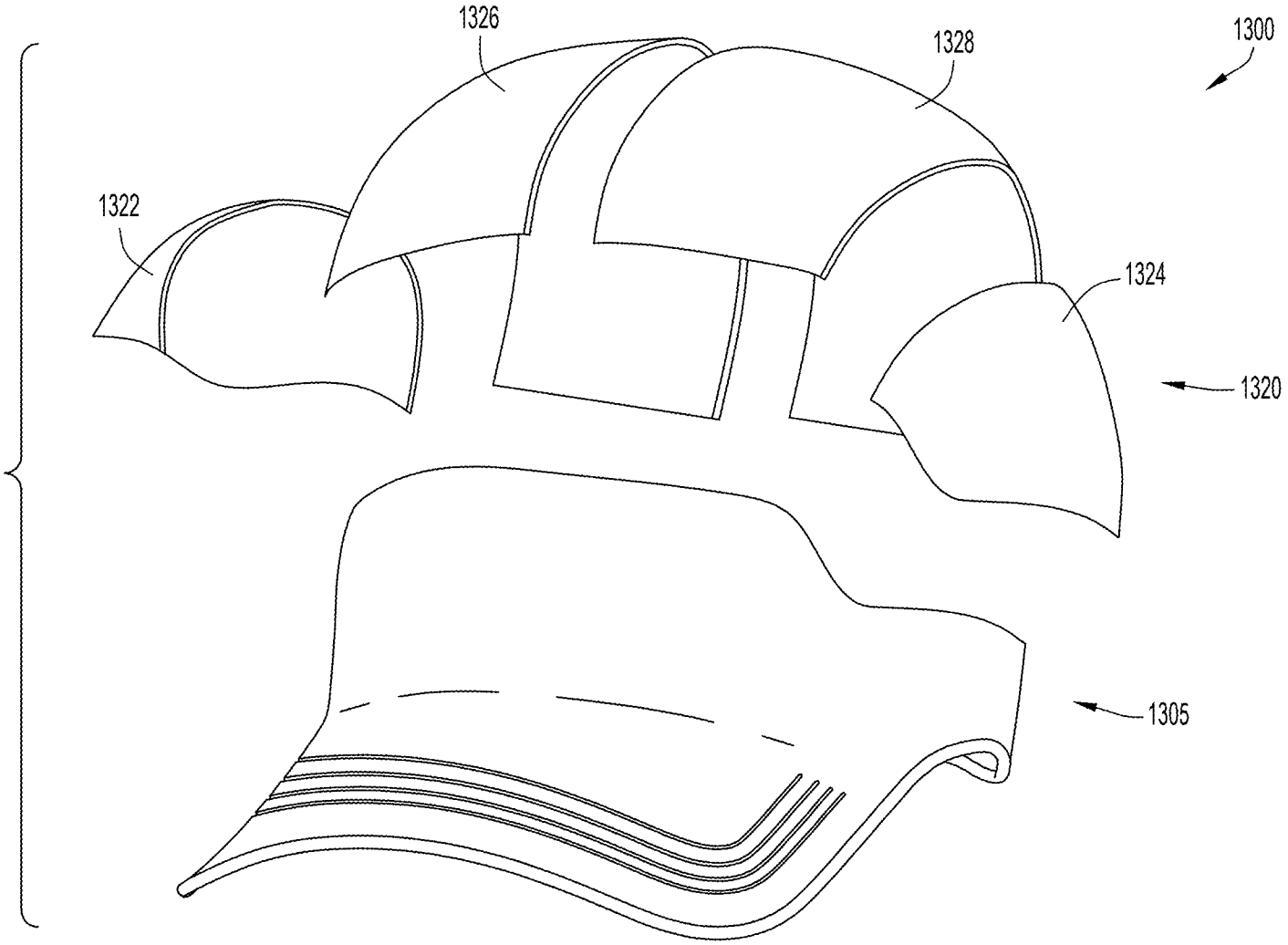
FIG. 13B is a partially exploded front view in perspective of the cap of FIG. 13A, in which the parts of the second portion have been separated.

Some non-limiting example embodiments of articles of headwear as described herein include a single, unitary member cap where the crown portion comprises a complete or full crown that encompasses the wearer's head (an example embodiment of which is described herein and depicted in FIGS. 1A-2C), a visor in which the crown portion is an open crown that partially covers the wearer's head (an example embodiment of which is described herein and depicted in FIGS. 12A and 12B), a cap including two or more molded components (an example embodiment of which is described herein and depicted in FIGS. 10A and 10B) and in which a first portion comprises a unitary molded member comprising the brim and a first crown portion and at least one further portion forms a further crown portion that defines the crown of the cap, and a cap including a molded component (an example embodiment of which is described herein and depicted in FIGS. 13A and 13B) and in which a first portion comprises a unitary molded member comprising the brim and a first crown portion and a second crown portion formed from one or more shaped members that combine with the first crown portion to define the crown of the cap.

In each of the embodiments, a crown portion of the article of headwear is integral and forms a single unitary molded member with the brim via a plurality of layers in which at least some of the layers are planar and molded to form a shape of the single unitary molded member that defines a transition region between brim and crown portion with a transition angle therebetween that is obtuse and further allows flexure of the crown portion and brim at or near the transition region so as to conform and provide a comfortable fit for the article of headwear worn on heads of various sizes and shapes.

In conventional headwear including a visor (also referred to herein as a cap, such as a baseball cap), the visor or brim is a separate component, i.e., separated from the crown portion which is shaped to fit over a portion (including top) of the head of a user or wearer. For example, the brim is typically a separate component that is connected via stitching or other suitable connection to the crown portion of the cap. In contrast, the article of headwear including unibody or unitary member as described herein (also referred to herein as a unitary molded member) is formed via a molding process in which the brim and crown, or at least a portion of the crown (i.e., crown portion), are a single, unitary molded member. In particular, the unitary headwear is formed including a plurality of layers in which at least one layer integrally forms, via the at least one layer, both the crown (or portion of the crown) and the brim of the cap.

Figure 1B:
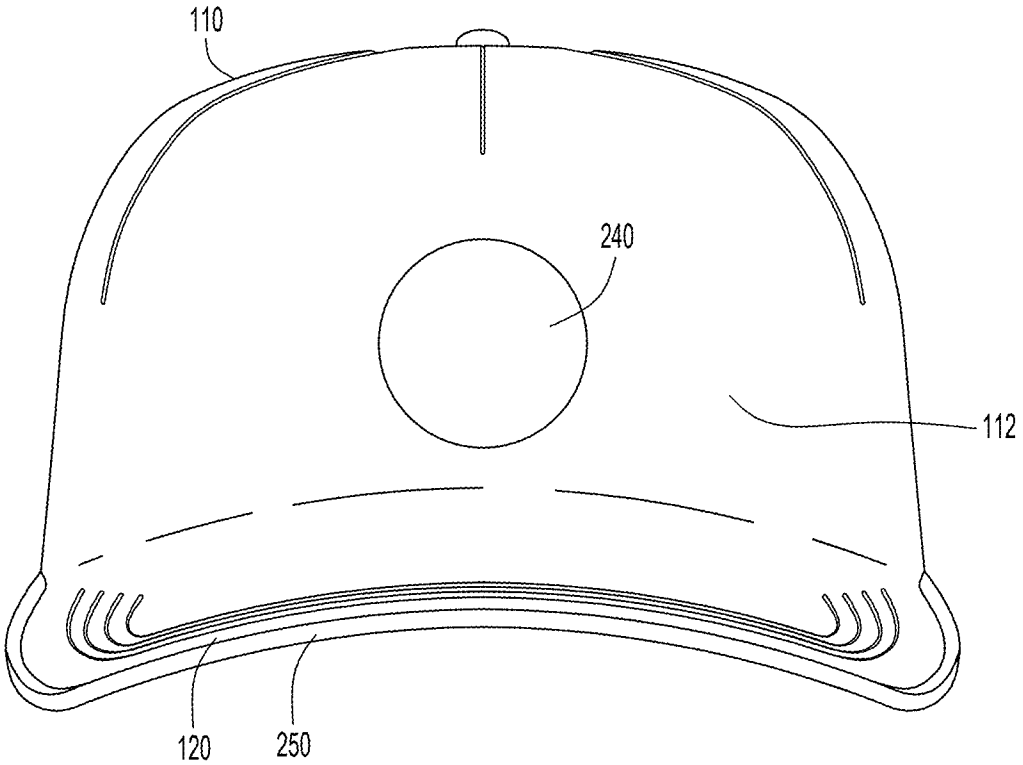
FIG. 1B is a front view of the cap of FIG. 1A.
Figure 1C:
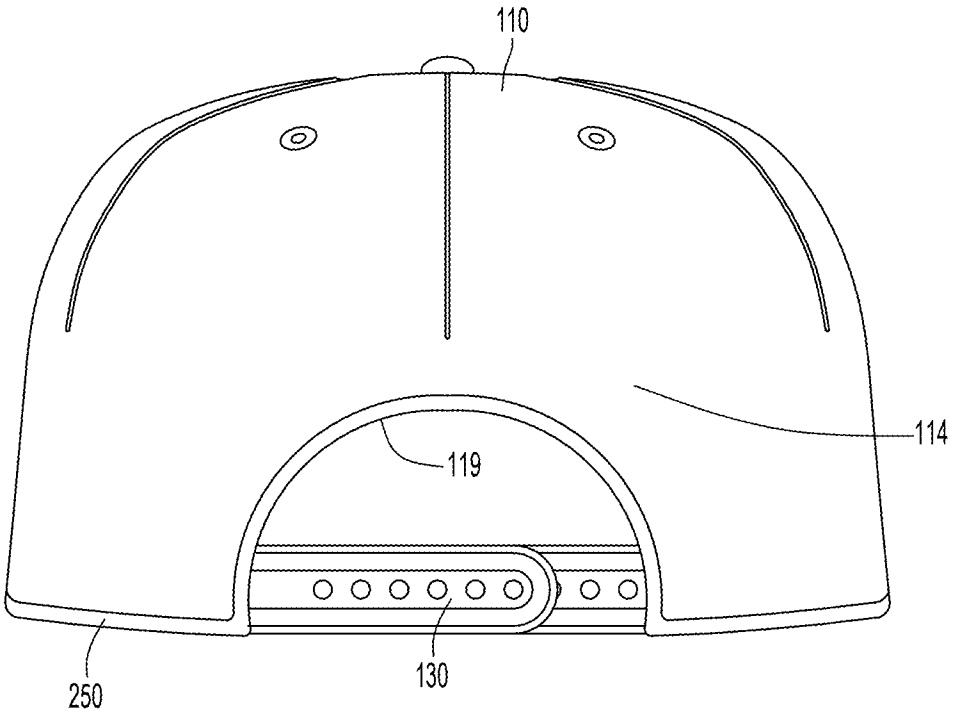
FIG. 1C is a rear view of the cap of FIG. 1A.

Referring to FIGS. 1A, 1B and 1C, an example embodiment of a unitary headwear or cap 100 is depicted, where the cap 100 includes a crown portion or crown 110 and a visor or brim 120 that extends transversely from a front side or front end 112 of the crown 110. The crown 110 comprises a semi-spherical shaped dome member generally sized to fit on a portion of the head of a human (i.e., over the top of the head, including a portion of the forehead of the human wearer), while the brim 120 extends from a lower edge and outward from the front end 112 of the crown 110. As shown in FIGS. 1A-1C, the crown defines a complete dome structure surrounding a top portion of the head of a wearer. In other embodiments as described herein, the crown can surround a portion of the wearer's head (e.g., a visor hat or visor cap as depicted in FIGS. 12A and 12B) while being open so as to expose a top portion of the head of the wearer. As is further visible from FIGS. 1A and 1B, the brim 120 can have a curved shape or profile, where the curvature is convex along the upper surface of the brim, where the convex curvature is defined transverse a length dimension of the cap 100 (i.e., transverse a linear dimension extending from front end of the cap at tip or free/terminal end of brim 120 to a rear end 114 of the cap and crown 110).

The crown 110 of cap 100 includes an inner surface that faces and aligns with the wearer's head when the cap 100 is worn. An opposing exterior or outer surface of the crown 110 is exposed and can include indicia (e.g., sports and/or company/business logos, represented as feature 240) as well as other molded features and/or other features (e.g., molded button 115, one or more eyelets 116 and/or one or more molded creases or molded panel ridges 118 that represent or mimic seams that define panels for the crown) that are formed on the outer surface during the molding/formation process of the cap 100. The brim 120 includes an upper side (including upper fabric layer 220) that corresponds with the exposed outer surface of the crown 110 and an underside (including lower fabric layer 230) that corresponds with the inner surface of the crown 110. Similar to features on the crown, the brim 120 can include features (e.g., molded grooves 125 representing faux seam lines, each groove including a general U-shape) formed during the molding/formation process of the cap.

At the rear end 114 of the crown 110, a cut-out section is formed and defined by a semicircular edge 119, and an adjusting band 130 extends across the cut-out section at the lower edge of the crown. The adjusting band 130 is secured to the crown 110 at its lower edge and the cut-out section. The band 130 can further include two facing band members that releasably couple with each other to facilitate adjustment of the circumferential dimension of the crown around the wearer's head based upon adjustable coupling of the band members together. The adjustable coupling of the band members together in different spaced configurations can be achieved via any suitable coupling structure including, without limitation, hook and loop (VELCRO®) fasteners, snap fasteners (e.g., rivet and slot fasteners, such as depicted in FIG. 1C), buckle type fasteners, etc.

Figure 2A:
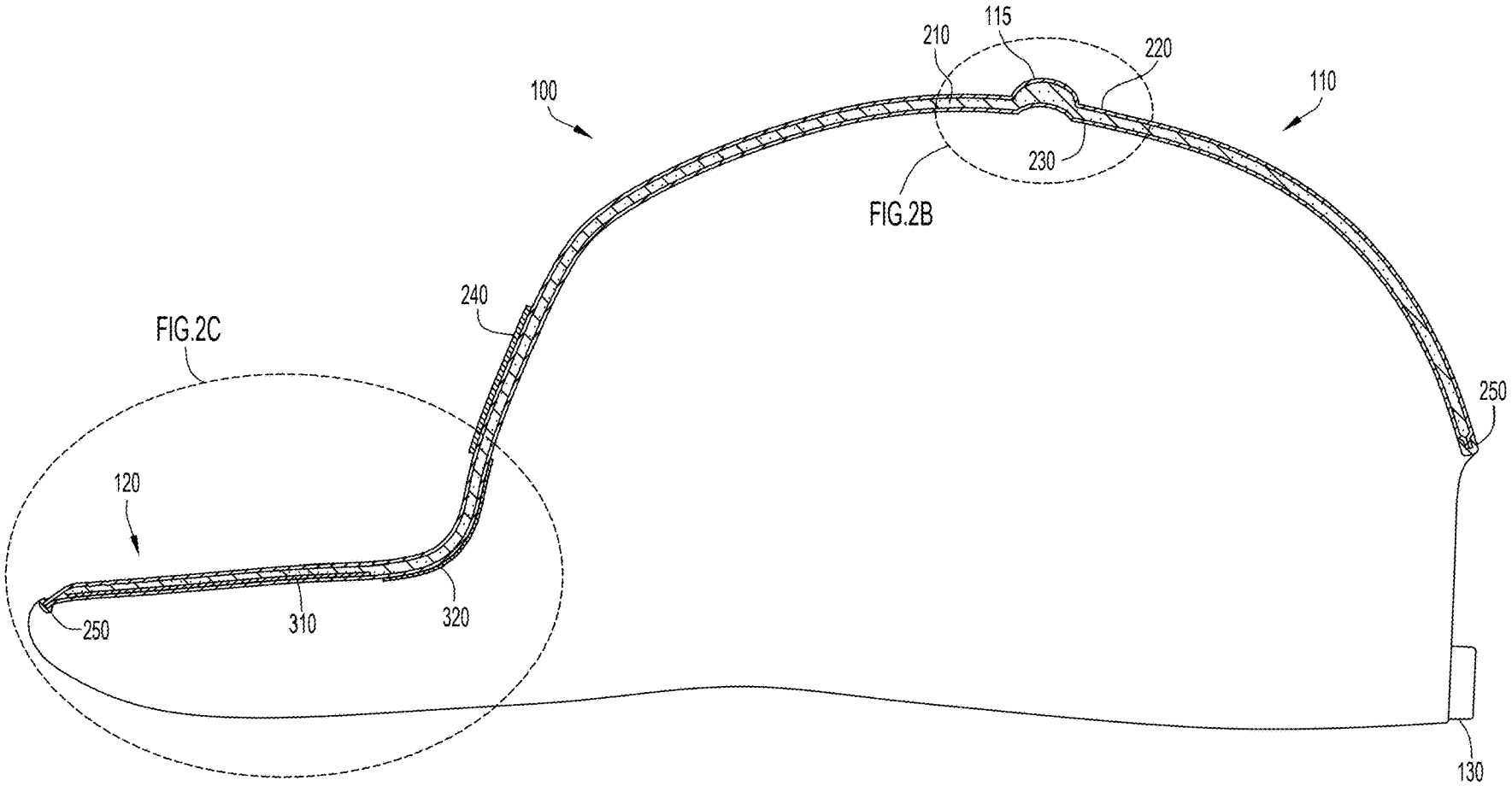
FIG. 2A is a cross-sectional side view of the cap of FIG. 1A.
Figure 2B:
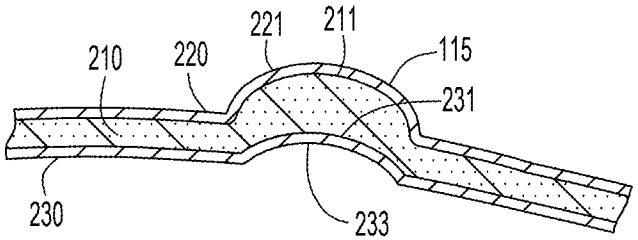
FIG. 2B is an enlarged cross-sectional side view of a portion of the cap of FIG. 1A including a molded button at the crown portion of the cap.
Figure 2C:
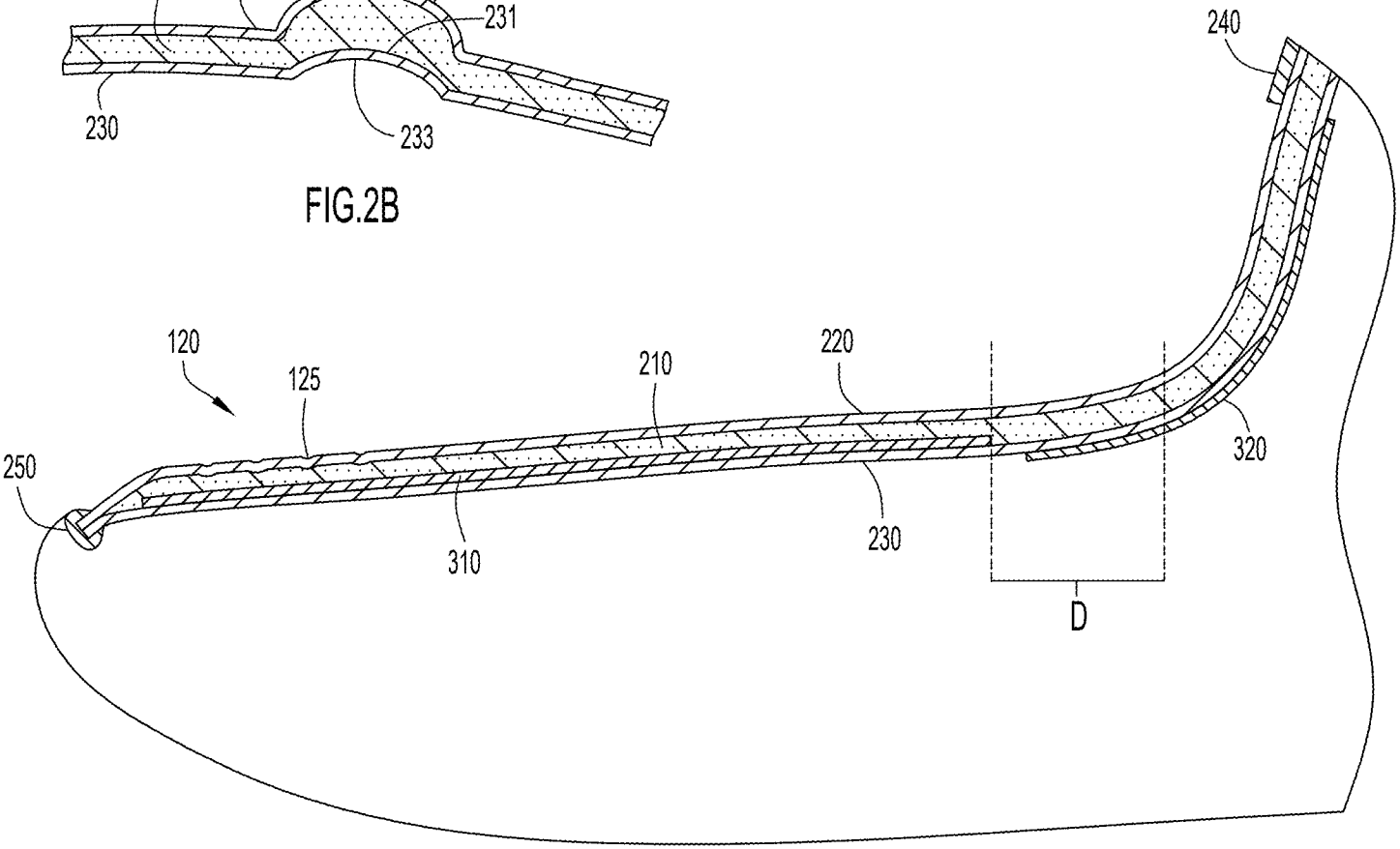
FIG. 2C is an enlarged cross-sectional side view of a portion of the cap of FIG. 1A including a transition region between brim and crown of the cap.

A cross-sectional side view of the cap 100 is depicted in FIG. 2A and also the partial views in FIGS. 2B and 2C. The cap 100 includes a plurality of layers that extend continuously between the crown 110 and brim 120 so as to form the cap including crown and brim as a single integral unit or structure. In the example embodiment, the cap 110 includes an interior or intermediate foam layer 210, an exterior or upper fabric layer 220 that forms the exterior or outer surface of the crown 110 and the upper side of the brim 120, and an interior or lower fabric layer 230 that forms the interior (i.e., head facing) surface of the crown 110 and the lower side of the brim 120. Each of the upper fabric layer 220, the intermediate foam layer 210 and the lower fabric layer 230 extends as a single, continuous layer along the cap from the brim to the crown, such that the combination of these layers integrally forms the brim and crown of the cap without the requirement of any seams or transitions between separate layer portions along the upper/exterior and lower/interior surfaces of the cap. In other words, and in contrast with conventional caps that require multiple surface layers that are stitched together to form portions of the crown as well as connections between the brim and crown, the cap as described herein requires minimal or no stitching, particularly in the seamless transition between brim and crown/crown portion. While the thicknesses of each of the layers 210, 220, 230 forming the cap can vary, each of these layers has a substantially uniform or constant thickness as the layer extends from a front end of the cap (at the front or terminal edge of the brim) to the rear end of the cap (rear end of the crown). However, it is noted that the thickness of any one or more of these and/or other layers forming the cap can have a thickness that varies along its length.

A binding material 250 (e.g., small piece of fabric or other material, such as binding tape) can be provided along the entire outer perimeter at the aligned edges layers 210, 220, 230 (including the front and rear edges where the layers terminate) so as to seal the cap at these edges (i.e., preventing exposure of the peripheral edges of the various layers forming the unitary molded structure for the cap). The binding material 250 can be folded over the peripheral edge portions of layers 220, 210, 230, etc. and secured in a suitable manner (e.g., via adhesive, welding, stitching, etc.). Thus, the intermediate foam layer 210 is encapsulated or contained between layers 220, 230 and the binding material 250 at the front and rear edges of the cap 100. The peripheral edges of the layers 210, 220, 230 are also covered by the binding material 250 that extends around the periphery of the cap.

In example embodiments, each of fabric layer 220 and fabric layer 230 can be constructed of the same or similar materials including, without limitation, woven fabric materials, knit fabric materials, nonwoven fabric materials, and embroidered fabric materials. Any suitable one or more types of yarns, filaments and/or fibers can be used to form the fabric materials forming fabric layers 220, 230, where the yarns, filaments and/or fibers can be formed as natural materials (e.g., cellulosic materials such as cotton and/or bamboo, protein materials such as silk, wool, soybean, etc.) and/or synthetic polymer materials. Some non-limiting examples of synthetic polymer materials that can be used to form synthetic yarns, filaments and/or fibers of the fabric materials include polyolefin fibers (e.g., polyethylene, polypropylene, etc.), polyester fibers (e.g., polyethylene terephthalate or PET fibers and poly(trimethylene terephthalate) fibers), polycaprolactam fibers, poly(hexamethylene adipamide) fibers, acrylic fibers, acetate fibers, rayon fibers, polyamide (nylon) fibers, aramid fibers (e.g., Kevlar fibers) and any one or more selected combinations thereof.

In an example embodiment, one or more of the fabric layers can comprise polyester and/or an elastomer material (e.g., elastane). In a further example embodiment, one or both the upper and lower fabric layers can comprise a fabric material including about 85% polyester and about 15% elastane (weight 215 g/m$^2$), and the reinforcement fabric layer 415 can comprise a fabric including about 79% polyester and about 21% elastane (weight 210 g/m$^2$). The upper and lower fabric layers may possess similar or different properties such as elongation properties. By way of example, the one of the fabric layers may possess a greater degree of elongation or elasticity along one or more dimensions (e.g., along a length and/or width of the fabric layer) in comparison to the other fabric layer.

The fabric materials can also include any suitable additives that modify or enhance thermal transfer properties of either or both of fabric layers 220, 230. For example, the lower fabric layer 230 (i.e., the fabric layer of the cap that faces and comes into contact with the wearer's head) may be a cooling fabric with an increased surface area contact heat transfer rate compared with conventional fabrics. In an embodiment, the cooling fabric includes filaments and/or yarns having a non-circular cross section (e.g., trilobal, rectangular, bowtie, or undulating). When knit into fabric, filaments and/or yarns with modified cross-sections aid in moisture transport and evaporation. Compared to fabrics formed of only filaments having a circular or rounded cross-section, a fabric including filaments having a non-circular cross section possesses an increased rate of moisture spread which, in turn, increases the evaporative effect of the fabric.

In a further embodiment, the lower layer fabric 230 may be configured to possess a high Qmax value (W/m$^2$) (As measured, e.g., by the following one or more testing standards: FTTS FA 019, GB/T 35263, and CNS 15687 L3272). The Qmax value is a measure of a fabric's heat transfer rate, representing the maximum amount of heat that can be transferred through one square meter of fabric in one second. This evaluation tests the surface temperature of a fabric and is used to indicate the instantaneous thermal feeling sensed when there is initial contact of the material with the skin surface. A higher Qmax value denotes that there is more rapid movement of heat from the body to the fabric surface resulting in a cooler feeling fabric. Stated another way, fabrics with higher Qmax rating have better cooling performance, as they can transfer more heat away from the body. These fabrics help regulate body temperature by absorbing and dissipating excess heat and moisture, preventing sweat buildup, and providing a cool and comfortable surface. In a preferred embodiment, the lower fabric layer 230 possesses a Qmax rating of 0.10 W/m$^2$-0.50 W/m$^2$), e.g., at least 0.1 W/m$^2$ or more and preferably at least 0.13 W/m$^2$. To raise the Qmax value of the fabric, the filaments having a higher Qmax value are selected. Stated another way, the filaments are formed of material having a higher Qmax value. In an embodiment, the filaments may be formed of polyester or nylon, each of which possesses a higher Qmax value than cotton. The Qmax value may be enhanced further by embedding cooling particles within the lower fabric layer. Cooling particles include, e.g., titanium dioxide, jade, mica, graphene, and any one or more combinations thereof. In a still further preferred embodiment, the filaments forming the lower fabric layer 230 include polyester filaments embedded with mica and possessing an undulating or cloud-shaped cross section.

The lower fabric layer and/or any other layers of the cap can also be configured to impart suitable moisture permeability for the cap during use. In particular, the cap, with features imparted to the lower fabric layer (and/or other layers of the cap) as described herein, can have a moisture permeability that is at least about 300 g/24 h/m$^2$, or at least about 400 g/24 h/m$^2$, or at least about 500 g/24 h/m$^2$, or at least about 600 g/24 h/m$^2$, or at least about 700 g/24 h/m$^2$, or even or at least about 800 g/24 h/m$^2$ or greater.

In still further embodiments, the fabric forming the cap (e.g., the interior fabric layer), may include a functional layer. Functional layers are ink or other coatings applied to the fabric that contain material operable to alter the base properties of the fabric. In an embodiment, the functional layer is thermal management print configured to alter the temperature regulation and/or moisture management properties of the fabric. In a specific embodiment, the lower fabric layer 230 can comprise a plurality of components that provide heat management or cooling properties to the fabric layer. For example, the lower fabric layer 230 can include any one or more components or a system of reactive components (i.e., components that are reactive to temperature/temperature changes in the environment in which the cap is worn) including, without limitation, a cooling agent, a latent heat agent, and a heat dissipation agent.

In particular, the cooling agent of the system reactive components can comprise an endothermic cooling agent, i.e., it creates a system that absorbs heat. For example, the endothermic cooling agent may possess a heat of enthalpy in the range −10 cal/g to −50 cal/g, or in the range −20 cal/g to −40 cal/g. With this configuration, when the cooling agent is contacted by water (i.e., the sweat of the wearer), the cooling agent is capable of cooling (i.e., lowering the temperature of) the water. Examples of the cooling agent include one or more polyols, such as one or more of erythritol, lactitol, maltitol, mannitol, sorbitol, and xylitol (e.g., one or more of sorbitol, xylitol and erythritol).

The latent heat agent of the system reactive components is capable of absorbing and releasing thermal energy from a system while maintaining a generally constant temperature. In example embodiments, the latent heat agent can comprise a phase change material (PCM). Linear chain hydrocarbons (e.g., paraffin linear chain hydrocarbons having 15-20 carbon atoms) are suitable for use as the phase change materials. For example, the phase change material may be selected to change phase at a temperature near (e.g., 1° C.-5° C. above or below) the average skin temperature of a wearer of the cap (i.e., a human wearer, e.g., 33° C.-34° C.). With this configuration, the phase change material begins to regulate temperature either upon placement of the cap on the head of the wearer or shortly after the wearer starts to warm up (e.g., in response to initiating any physical activity).

The heat dissipation agent of the system reactive components can be provided to effectively conduct heat and/or direct heat from one location to another location within the system (e.g., within the fabric layer). In an embodiment, the heat dissipation agent possesses a high heat capacity, which determines how much the temperature of the agent will rise relative to the amount of heat applied. By way of example, the heat dissipation agent is a silicate mineral such as jade, e.g., nephrite, jadeite, or combinations thereof.

When employing system reactive components within the lower fabric layer 230, the mixture of components can include the cooling agent in an amount of from 15 wt % to 35 wt % of the system reactive components, the latent heat agent in an amount of from 25 wt % to 45 wt % of the system reactive components, and the heat dissipation agent in an amount of from 25 wt % to 45 wt % of the system reactive components. The system reactive components can also be provided in a polymeric binder material and dispersed in any suitable manner in the lower fabric layer or even coating the exposed surface of the lower fabric layer 230.

The previous embodiments provide thermal transfer properties within one or more layers of the cap for warmer environments in which it is desirable to providing cooling to the head of the wearer. In a further embodiment, the cap can also be provided with a functional layer operable to promote heat retention to the head of the wearer, e.g., in cold or cooler climates.

For example, the lower fabric layer 230 can include a ceramic material provided along the exposed surface (i.e., surface facing the head of the wearer) in any suitable pattern along the exposed surface. Such ceramic material can be provided, e.g., as an ink printed on the exposed surface of the fabric layer, where the ceramic may include be any of various ceramics appropriate for inclusion on the exposed surface of the fabric layer including both oxide ceramics and non-oxide ceramics. For example, the ceramic material can comprise one or more of silica, zirconium carbide, aluminum oxide, or any of various other ceramic materials.

The functional layer may further be capable of absorbing heat energy radiated by the user and converting the energy into IR radiation (e.g., far IR radiation) that is directed back toward the user. These materials are known as bioceramic materials. For example, a bioceramic composition includes a bioceramic material (described above) and a binder effective to disperse the components and/or to adhere the temperature reactive components to a substrate (e.g., to the yarns/fibers forming the substrate). The binder may be an elastomeric material possessing good elongation and tensile strength properties. Elastomeric materials typically have chains with high flexibility and low intermolecular interactions and either physical or chemical crosslinks to prevent flow of chains past one another when a material is stressed. In an embodiment, polyurethane (e.g., thermoplastic polyurethane such as polyester-based polyurethane) is utilized as the binder. In other embodiments, block copolymers with hard and soft segments may be utilized. For example, styrenic block copolymers such as a styrene-ethylene/butylene-styrene (SEBS) block copolymer may be utilized.

These bioceramic materials include ceramic oxide materials and non-oxide ceramic materials including, without limitation, silicon oxides or silica (e.g., $SiO_2$), zirconium oxides (e.g., $ZrO_2$), titanium oxides (e.g., $TiO_2$), aluminum oxides (e.g., $Al_2O_3$), magnesium oxides (e.g., MgO), yttrium oxide ($Y_2O_3$), zirconium carbide (ZrC), and titanium carbide (TiC), and combinations thereof.

In ink form, the amount of bioceramic material within the ink can range from about 2% by weight to about 50% or greater by weight. For example, the amount of bioceramic material within the bioceramic ink can be in an amount of at least about 2% by weight, by at least about 5% by weight, by at least about 25% by weight, by at least about 30% by weight, but at least about 40% by weight, or by no greater than about 50% by weight. In another example, the amount of bioceramic material within the bioceramic ink can be in an amount of about 5% by weight to about 15% by weight, or from about 8% by weight to about 12% by weight (e.g., about 10% by weight).

The composition forming the functional layer (e.g., the thermal management or bioceramic printed layer) is applied to the fabric in a manner that maintains the integrity of the components and preserves properties of the substrate (the textile or fabric). In an embodiment, the composition transferred to the substrate via printing process. By way of example, the composition is transferred to the textile or substrate via a rotogravure apparatus including an impression roller, a gravure or etched cylinder, and a tank. The cylinder is engraved/etched with recessed surface cells in a desired pattern. The tank holds the composition. The apparatus further includes a doctor blade operable to remove excess composition from the cylinder. In operation, as the cylinder rotates, a portion of the cylinder becomes immersed in the composition stored in the tank. The composition coats the cylinder, becoming captured within the cells. The cylinder continues to rotate, moving the coated cylinder past the doctor blade, which removes excess composition from the cylinder. The textile is directed between the impression roller and the cylinder such that the inner surface of the substrate (e.g., what will be the wearer-facing side of the apparel) contacts the cylinder. Specifically, the impression roller applies force to the substrate, pressing the textile onto the cylinder, thereby ensuring even and maximum coverage of the composition. Surface tension forces pull the composition out of the cells, transferring it to the substrate. Once the composition is transferred, the coated textile may pass through one or more heaters to evaporate the solvent, thereby drying the composition and forming the dry print layer. If a thicker coating is desired, additional passes through the rotogravure apparatus may be completed.

The application or print pattern for the functional layer can be of any suitable types, such as a pattern of repeating and/or nested patterns of segments printed as a layer on the fabric surface. Any types of shapes (e.g., circular shapes, polygonal shapes, and irregular shapes) of bioceramic material printed as layers on the fabric surface. The pattern is a discontinuous pattern including printed areas interrupted by non-printed areas, and vice versa. Printed areas are those areas covered with the function composition (applied as, e.g., a coating, film or print). Non-printed areas are those areas free of the functional composition (i.e., not covered by the composition), thereby leaving the textile exposed. The textile includes the textile itself, or the textile with coatings other than the functional composition (e.g., an antimicrobial coating, a durable, water-resistant coating, etc.).

In general, the pattern includes an arrangement of printed segments spaced apart by non-printed segments, called hinges. Each segment and hinge may possess any dimensions suitable for its intended purpose. In addition, the segments and hinges may be ordered into cells or units defining a repeating or random pattern across the textile surface. By way of specific example, the functional composition printed pattern includes substantially linear segments arranged in a spaced apart and non-parallel manner in relation to each other to define selected angles (e.g., angles that are at 90° or greater, such as obtuse angles) between the linear segments. Additionally, the cells may include concentrically aligned or nested patterns of such linear segments. The nested patterns can include polygonal shapes (e.g., polygons having four or more sides, e.g., squares or rectangles, pentagons, hexagons, etc.) that are nested within the same or similar polygon shapes. The linear segments can be of the same or similar width and/or thickness or, alternatively, can have different widths and/or thicknesses.

As an alternative to (or in addition to) printing or applying the bioceramic material as a layer on the fabric surface, functional materials can also be incorporated within filaments, fibers and/or yarns of the fabric forming the fabric. Some examples of bioceramic fibers, filaments or yarns that can be integrated within bedding components of the bedding system include, without limitation: a polyethylene terephthalate (PET) fiber including one or more bioceramic particles (e.g., silicon oxide and/or aluminum oxide) embedded in the core of the fiber, such as fibers commercially available under the trade name CELLIANT® (Hologenix, LLC, California); a polyamide (e.g., nylon 6,6) yarn incorporated with bioceramic particles (e.g.,), such as a bioceramic yarn commercially available under the trademark EMANA® (Solvay Group, Belgium); and a combination of cotton and bioceramic yarn, such as is commercially available from SAMINA® (Germany).

For example, yarns including a bioceramic material can be provided for forming a woven, knitted, nonwoven or any other type of fabric material. The number, types and placement of yarns including bioceramic material within the fabric material can be selectively controlled to achieve a desired amount of bioceramic material per unit of fabric (e.g., about 0.5 g/yd2 to about 30 g/yd2) at selected locations within the fabric material. Further, the fabric material forming a panel or sheet of the bedding component can include any selected number of layers of intertwined yarns, with yarns including bioceramic material being disposed at any selected locations throughout the thickness of the fabric material.

The intermediate foam layer 210 can comprise any suitable foam material, such as a polyurethane foam material. In addition, two or more foam layers can also be provided as part of the layers forming the textile laminate or unitary molded member of the cap. Each foam layer provided in the fabric laminate can comprise any suitable one or more type(s) of open and/or closed cell foam materials that provide adequate cushioning and comfort for the intended purpose. In particular, an open-celled, thermoplastic foam may be utilized. Some examples of types of foam materials suitable for use in forming the headwear include, without limitation, polyolefins (e.g., polyethylene or polypropylene) foam materials, ethylene vinyl acetate (EVA) foam materials and polyurethane (PU) foam materials. Foam layers can vary in thickness depending upon where such foam layers are located along the headwear. For example, a foam layer provided in a brim portion can have a thickness that is greater than the thickness of a foam layer within the crown portion (and vice versa). In an embodiment, a foam layer that is about 6.0 mm thick is provided between fabric layers. In further example embodiments, the foam material has suitable heat transfer properties that facilitate heat transfer between the head of the wearer and the surrounding environment so as to keep the wearer comfortable while wearing the cap (particularly in warmer climates). In other embodiments, the intermediate layer can include a material other than foam. For example, an intermediate layer for the textile laminate or unitary molded member can comprise a textile of fabric layer, such as a woven fabric layer, a knit fabric layer, an embroidered fabric layer, or a nonwoven fabric layer.

The fabric layers 220, 230 can be formed so as to have the same or similar thicknesses and/or have the same or similar degree of stretch. Similarly, the intermediate foam (or other material) layer 210 can have the same or similar degree of stretch or elongation properties as each of the fabric layers 220, 230. In example embodiments, one or both of the upper and lower fabric layers and the intermediate layer can be formed from suitable materials such that each layer (separate and independent from each other) has an elongation of at least about 40%, or at least about 50%, or from about 50% to about 75%, or from about 50% to about 70% in a length direction of the cap 100 (i.e., from the free or terminal end of the brim 120 to the rear end 114 of the crown 110). One or more of the upper and lower fabric layers and the intermediate layer can also have an elongation of at least about 60%, or at least about 70%, or at least about 80%, or at least about 90%, or from about 90% to about 120%, for from about 93% to about 107% in a width direction of the cap (i.e., a direction that is transverse the length direction of the cap). As used herein, the term "elongation" refers to an increase in dimension at a point of break or failure of the material when subjected to a force or load in a particular direction in comparison to an original dimension, in accordance with the formula: $(L_{failure}-L_{original}/L_{original})\times 100$. Providing one or more layers with such elongation properties provides suitable elongation or stretch properties for the cap.

A recovery of one or more of the upper and lower fabric layers and the intermediate layer in the length direction and the width direction can be at least about 60%, or at least about 70%, or at least about 80%, or at least about or greater than 85%. The term "recovery", as used herein, refers to an ability or degree of the material to recover to its original dimension, or some percentage thereof, after having been stretched by a load and then relaxed after removal of the load. Thus, a recovery of 100% indicates that the material has relaxed back to its original length prior to being subjected to a stretching load, while a recovery of 90% indicates that the material is 10% greater in length than its original length after release of a stretching load and recovery of the material to a relaxed state. Providing recovery features for the one or more layers forming the cap also imparts suitable recovery properties for the cap, allowing it to deform (e.g., expand) and then resume (e.g., contract) its original configuration when placed on different head sizes of wearers or bent, folded or compressed in various configurations.

As previously noted, the cap 100 can be revised to include one or more further layers between upper and lower fabric layers 220, 230. For example, in other embodiments, the intermediate foam layer 210 can be modified or replaced with a textile or fabric layer, such as a knit, woven, embroidered or nonwoven layer, that includes yarns of varying types that impart structural features to the cap. For example, an intermediate fabric layer can be provided (replacing the intermediate foam layer or in addition to the intermediate foam layer) including fusible yarns and/or non-fusible yarns arranged at one or more suitable locations of the intermediate fabric layer. Fusible yarns can be formed of lower melt polymers that may soften or partially melt during the molding process that forms the headwear (as described in further detail herein) when sufficient heat is applied at or above the glass transition temperature of the lower melt polymer. For example, the glass transition temperature of the fusible yarns used to form the intermediate fabric layer can be no greater than about 150° C. (e.g., temperature at which the molding process is performed). The lower melt polymer recrystallizes and hardens when cooled to ambient temperature. A non-limiting example of a fusible yarn comprises a thermoplastic polymer material such as low melt polyester, low melt polyurethane or low melt polyolefin.

Non-fusible yarns are those having a much greater glass transition temperature and melting temperature in relation to the fusible yarns, where the non-fusible yarns remain solid (i.e., do not soften or become partially molten) during the molding process of the headwear. In other words, the non-fusible yarns can have a glass transition temperature that is greater than the temperature applied during the molding process/formation of the cap. Crossing yarns at one or more areas of the fabric layer can comprise fusible and non-fusible yarns such that, during the molding process, the fusible yarns partially melt and solidify and fuse with the non-fusible yarns at their intersections. Such fusing of fusible yarns with non-fusible yarns at selective crossing yarn locations results in a stiffening of the fabric structure which can in turn impart structural integrity to the headwear along its contour after the molding process.

In still further embodiments, the upper fabric layer and/or the lower fabric layer can be formed with fusible and non-fusible yarns in which the fusible yarns melt and fuse with non-fusible yarns and/or other fusible yarns during the molding process to enhance structural integrity for the headwear at one or more desired locations. Further, one or more textile layers of the headwear (e.g., intermediate fabric layer, upper fabric layer and/or lower fabric layer) can be formed entirely of fusible yarns which, upon molding the layer, results in the fusible yarns bonding or fusing with other intersecting fusible yarns due to the melting or partial melting of the fusible yarns during the molding process. The number, types and amount of fusible yarns, with or without non-fusible yarns, can be selected for a particular textile layer of the headwear based upon a desired degree of stiffness for the layer that imparts desired structural integrity to the headwear at one or a variety of locations as a result of the fusing of yarns at crossing yarn locations within the fabric layer(s) upon mold forming of the unitary portion of the headwear.

In example embodiments, each of the upper and lower fabric layers 220, 230 and the intermediate foam (or other material) layer 210 can have a thickness ranging from about 0.25 mm to about 7 mm, or from about 0.50 mm to about 5 mm. In example embodiments, the lower fabric layer 230 can have a thickness ranging from about 0.25 mm to about 0.75 mm (e.g., about 0.50 mm), the upper fabric layer can have a thickness ranging from about 1.5 mm to about 2.0 mm (e.g., about 1.8 mm), and the intermediate foam layer 210 can have a thickness ranging from about 1 mm to about 10 mm, or from about 2 mm to about 8 mm, or from about 2 mm to about 5 mm. After formation of the cap (via compression molding), the layers are compression bonded together, resulting in a total thickness of all three layers 210, 220, 230 ranging from about 1 mm to about 3 mm, or from about 2 mm to about 2.5 mm.

One or more internal structural support members can also be provided within the textile laminate or unitary molded member that forms the headwear. The one or more internal structural members can be formed of any suitable type(s) materials that deform during the compression molding process and provide resilient structural support for the headwear at the location(s). The materials forming the internal structural support members can possess a desired hardness value that is greater than the hardness value (e.g., Shore A hardness) of the materials used to form the foam and fabric layers of the fabric laminate. Some examples of materials that can be used to form the internal structural support members include, without limitation, polyurethanes, polyolefins, polyamides (e.g., nylon), ethylene vinyl acetate (EVA), etc. In example embodiments, one or more internal structural support members are formed from a thermoplastic polyurethane (TPU) material, such as a TPU material commercially available from Chemex Company Ltd. During the formation of the fabric laminate or unitary molded member, the internal structural support member can be formed from a non-foamed flat sheet that is contoured during the compression molding process. In an embodiment, the structural support member possesses a Shore A hardness of from about 40 to about 90, and preferably less than 70 Shore A. Alternatively, the internal structural support member can be formed from starting materials comprising a powder composition that is fused and hardened into a single, unitary molded member either prior to or during the compression molding process. The internal structural support member can have a thickness in the range of about 0.2 mm to about 2.0 mm (e.g., a thickness of about 1.0 mm).

In an example embodiment, a structural support member can be in the form of a reinforcement member or reinforcement plate 310 that is encapsulated or contained within the cap 100 at the brim 120. The reinforcement plate 310 adds some rigidity or reinforcing strength to the brim 120 and, optionally, also to a portion of the crown 110. The reinforcement plate 310 is made of a hard polymer or plastic material (e.g., a non-foam material such as polyamide (e.g., nylon) or polyurethane, or other suitable material (e.g., hard foam material) having a hardness or durometer value (e.g., as measured on a Shore durometer scale) that is greater than the hardness or durometer value of each fabric layer 220, 230 and the foam layer 210. The plate 310 also does not have the same elongation properties and is thus not similar in elongation as the fabric and foam layers that extend entirely between the front and rear ends of the cap. The reinforcement plate further has suitable dynamic flexibility and resiliency to facilitate bending under a force or load applied to the plate and returning to its original relaxed configuration after removal of the load. The plate 310 is located between the intermediate foam layer 210 and the lower fabric layer 230. In alternative embodiments, the reinforcement layer 310 can be located between intermediate foam layer 210 and upper fabric layer 220. The reinforcement plate 310 can optionally include a series of through-holes or perforations extending through the plate so as to reduce its weight as well as provide adequate ventilation (e.g., airflow) along and through the brim 110 (see, e.g., FIGS. 3A and 3B as described herein).

As shown in FIG. 2C, the reinforcement plate 310 does not extend the entire length of the brim 120. Instead, the plate 310 extends so as to end a selected distance D (e.g., at least 3 mm) from the transition between brim 120 and crown 110. In another embodiment, the reinforcement plate 310 can extend substantially the full length of the brim 120 and terminate at or slightly before the transition region between brim and crown so as to not extend around the transition region into a portion of the crown. In a further embodiment, the plate 310 can extend beyond the transition, extending from the brim portion and into the crown portion (so as to extend along the transition region from brim to crown, see, e.g., FIG. 3C), where the plate is three dimensional and suitably angled along the transition region between brim and crown to facilitate cushion and flex to the brim as well as a certain rigidity but also adequate flexion between brim and crown when the cap is worn. In an embodiment, the rear plate portion curves upward at an angle similar to that of the transition. In embodiments in which the reinforcement plate extends beyond the transition between the brim and crown, a portion of the reinforcement plate extending around the transition between the brim and crown, as well as a portion on each side of transition, can have a tapered configuration or a reduced thickness in comparison to other portions of the reinforcement plate. For example, the reduction in thickness of the reinforcement plate at the portions extending around the transition between brim and crown can be at least about 5%, or at least about 10%, or at least about 20%, or at least about 30%, or at least about 40%, or at least about 50% in relation to the greatest thickness of the reinforcement plate at other portions.

A sweatband layer 320 can also be provided along an interior or lower surface portion of the cap or an exposed surface portion of fabric layer 230 so as to cover the transition between the brim 120 and crown 110 (i.e., where the cap transitions between brim and crown). The sweatband layer 320 can be constructed of any suitable fabric or other material that has a suitable softness, since it provides engagement between cap and a portion of the wearer's forehead when the cap is worn. The sweatband layer 320 can also have suitable wicking or moisture absorbing properties to absorb moisture or sweat from the forehead of the wearer in use. For example, the sweatband layer can adequately wick moisture from the lower surface of the cap for a wicking distance of 100 mm or greater in 30 minutes (based upon a droplet wicking distance test). The sweatband layer can further be constructed so as to have similar stretch or elongation properties as the fabric layers 220, 230 and the foam layer 210. In example embodiments, the sweatband layer comprises a polyolefin or polyurethane material having suitable wicking properties. For example, the sweatband layer can have suitable hydrophilic properties that effectively wick or absorb moisture from a contacting surface, e.g., the forehead of the wearer of the cap.

Figure 3A:
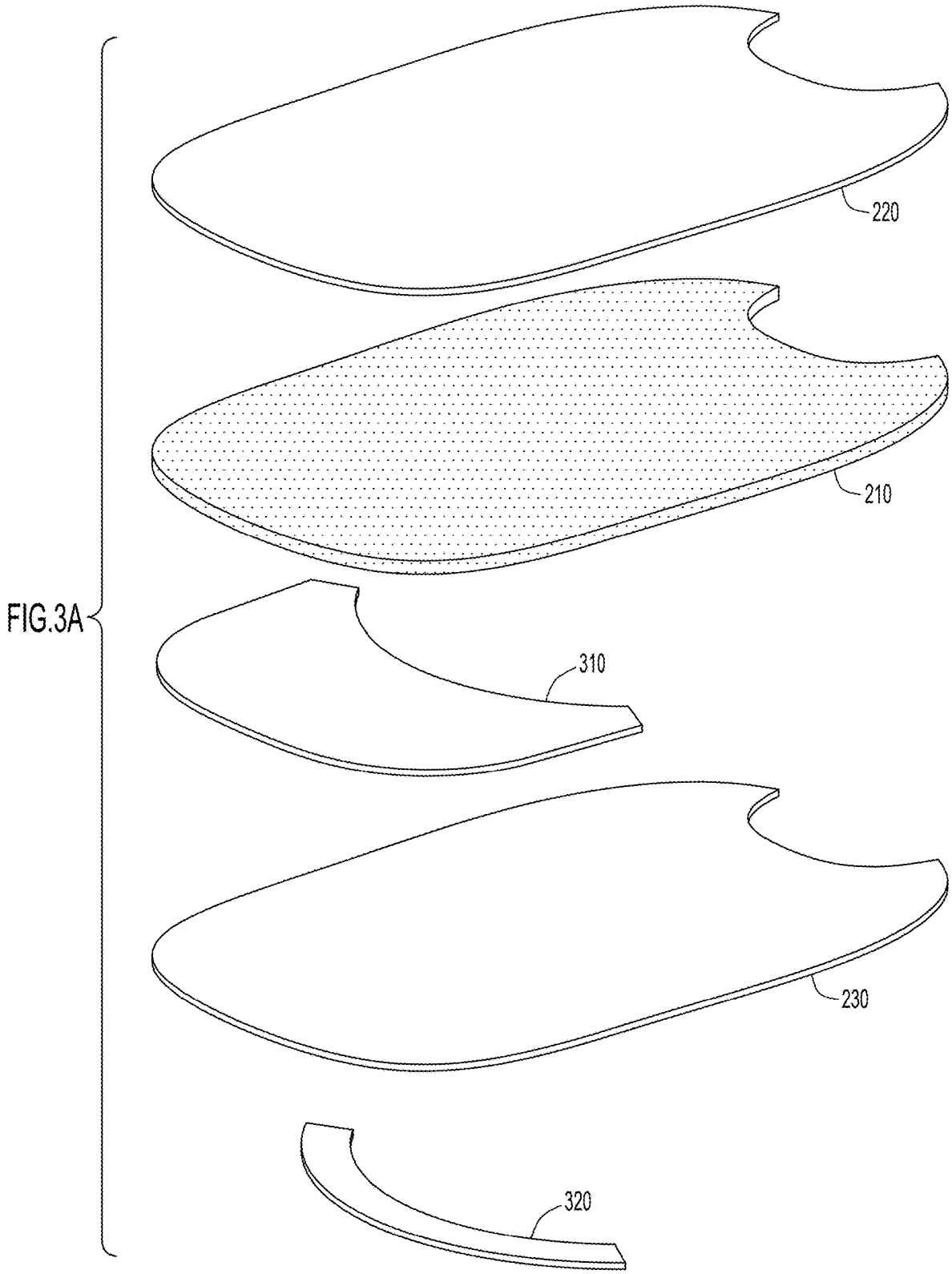
FIG. 3A is a view of the various layers in isolation that are used to form the cap of FIG. 1A.

The cap 100 is formed as a single, integral structure or unit with a plurality of layers and with few or no seams that could present hard and/or abrasive surface portions that can rub hard, chafe or irritate the skin on the forehead of the wearer. The formation of the cap as a single, integral or unitary structure is realized by shaping the cap with all of its layers in a single step molding process in which the core layers are combined and adhered to each other as a result of the molding process. Referring to FIG. 3A, each of the layers can be provided in their respective shapes or forms and then stacked upon each other in the arrangement that forms the cap 100 as shown in the cross-sectional views of FIGS. 1-2. Each of the foam layer 210 and fabric layers 220 can include an arc or concave cut-out section at their respective rear ends to correspond with the cut-out arc section 119 at the rear end 114 of the cap 100 when the cap is formed (as shown in FIG. 1C). The front edge of each of the layers 210, 220, 230 is rounded or convex in shape to correspond with the front end of the cap 100/free or terminal edge of the brim 120 when the cap is formed. Each of the layers 210, 220, 230 can further have a generally planar shape or configuration prior to being formed. The reinforcement plate 310 has a concave or arc contour at its rear edge that generally corresponds with the curved shape of the transition between brim and crown when the cap is formed. The plate 310 further has a rounded, convex contour or shape at its front edge that corresponds with the rounded, convex contour at the front edge of each of the layers 210, 220, 230. The sweatband layer 320 has a general arc shape to correspond with the shape of the transition between brim and crown when the cap is formed. Each of the plate 310 and sweatband layer 320 can also have a generally planar shape prior to being molded to form the cap 100.

While the embodiment of FIGS. 1-2 has an orientation (e.g., vertical orientation, or from upper fabric layer 220 to lower fabric layer 230) of layers as presented in FIG. 3A, it is noted that other embodiments of the cap can include any other suitable orientation of layers. For example, as previously noted, the reinforcement play can be provided above (i.e., closer to the upper fabric layer) or below (i.e., closer to the lower fabric layer) the intermediate (foam) layer. In addition, any one or further number of additional layers can also be provided within (e.g., located between the upper and lower fabric layers) or integrated as part of the cap. In one embodiment, a cap can be provided having a similar configuration as that depicted in FIGS. 1-3, but with a further intermediate (e.g., foam) layer disposed below the reinforcement plate. In other words, the reinforcement plate can be disposed or sandwiched between a first intermediate (e.g., foam) layer and a second intermediate (e.g., foam) layer.

Figure 3B:
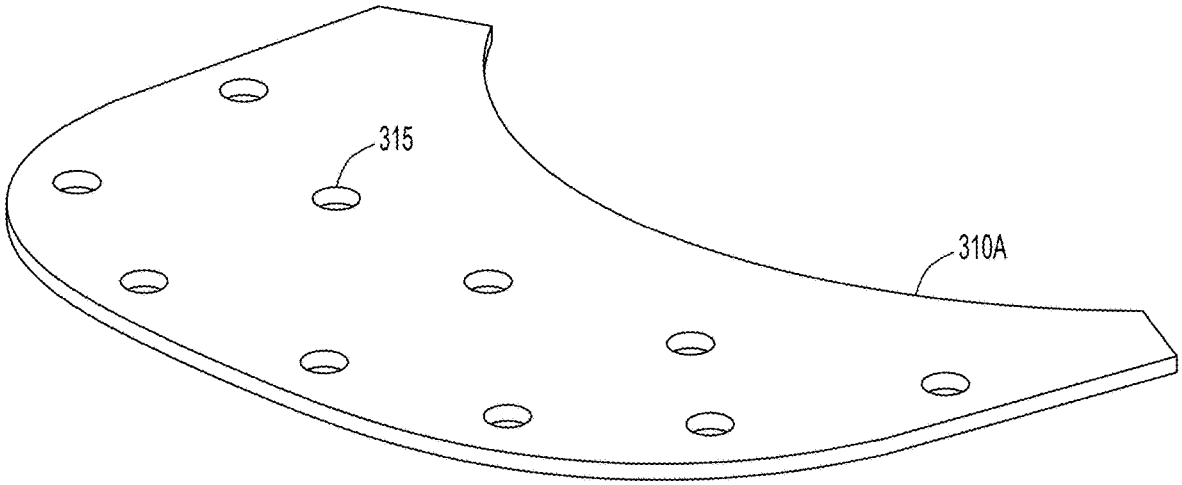
FIG. 3B is a view of another embodiment of the reinforcement plate for the cap of FIG. 1A.
Figure 3C:
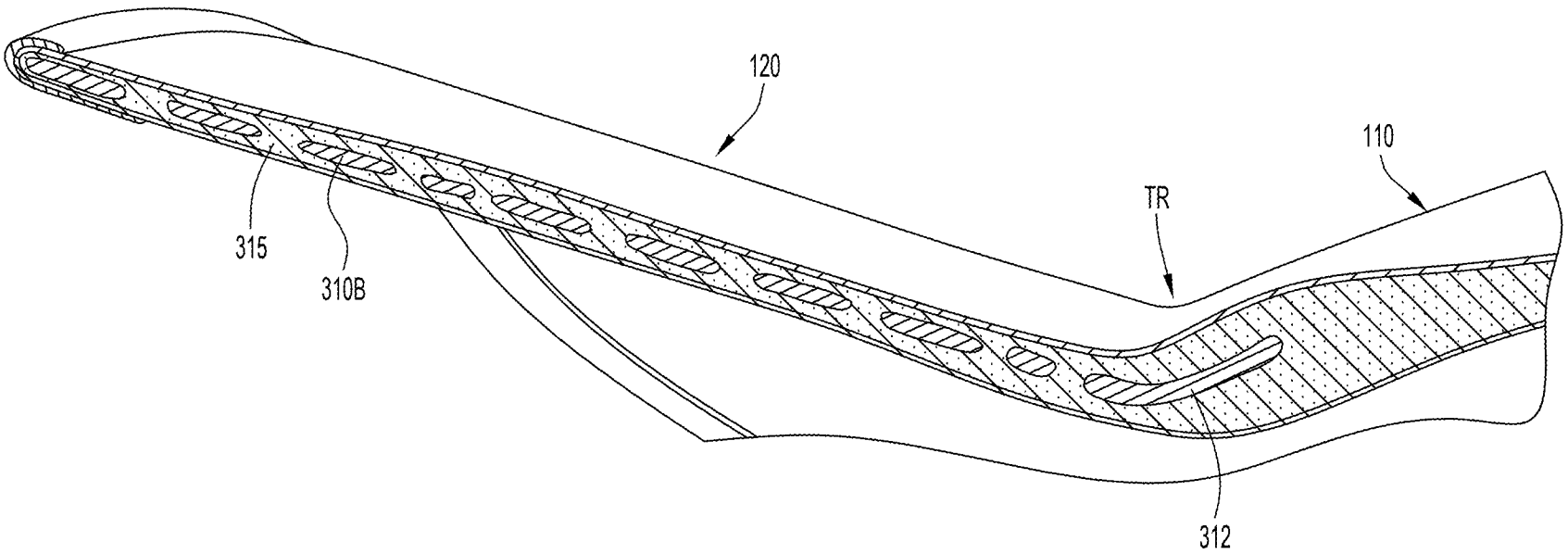
FIG. 3C is a cross-sectional side view of a cap similar to the cap depicted in FIG. 1A but with a further embodiment of a reinforcement plate incorporated within the cap (where the cross-section is taken through the cap and at a series of through-holes extending through the reinforcement plate of the cap).

As previously noted, the reinforcement plate can also include further features, such as providing perforations or through-holes through selected portions of the reinforcement plate. An example embodiment of a reinforcement plate 310A is depicted in FIG. 3B, where perforations or through-holes 315 extending through the plate 310A along a selected surface area of the plate (e.g., over 50% of the surface area as shown in FIG. 3B). Such through-holes 315 reduce the weight of the plate 310A as well as provide adequate ventilation (e.g., airflow) along and through the brim 110. In a further embodiment (FIG. 3C), a reinforcement plate 310B can also be provided including through-holes 315 and also a curved portion 312 of the plate 310B that extends beyond the transition region TR between brim 120 and crown 110. In this embodiment, the plate 310B is three dimensional in shape and suitably angled along the transition region between brim and crown to facilitate cushion and flex to the brim as well as a certain rigidity but also adequate flexion between brim and crown when the cap is worn. In addition, upon molding of the unitary portion of the cap, including upper and lower fabric layers, intermediate (foam) layer, and the plate, the through-holes 315 of the plate 310B permit portions of the intermediate (foam) layer to extend through the through-holes (as shown in FIG. 3C).

This can enhance the firmness and rigidity of the brim and also firmly secure and prevent any slight or floating movement of the reinforcement plate within the brim.

The compression molding process used to form the fabric laminate or unitary molded member of the headwear comprises a method of molding in which the molding material comprising layers is first placed in an open, heated mold cavity. The mold is closed with a top force or plug member, pressure is applied to force the material into contact with all mold areas, while heat and pressure are maintained until the molding material has cured. The temperatures and pressures used in the compression molding process will depend upon the materials used to form the various layers within the fabric laminate, where softening of one or more layers is required to ensure suitable adhesion of the layers together during the compression molding process. In particular, softening of the one or more layers comprises being heated to a temperature that is lower than the melting point of the materials forming the layers (e.g., the softening temperature is at least about 20° C. lower than the melting point of the materials forming the layers). Example softening temperatures used during the compression molding process can be in the range from about 130° C. to about 200° C. (e.g., about 140° C. to about 190° C.).

A mold can be provided that is suitably configured and dimensioned to receive the various layers 210, 220, 230, 310, 320 and process the layers via heat and/or compression within the mold to adhere the layers together and form a single, unitary composite structure that defines the cap including crown and brim. An example embodiment of a mold including two portions (e.g., clam shell mold) is depicted in FIGS. 4A, 4B, 4C, 4D and 4E. In particular, the mold 400 can comprise a shell configuration with two shell portions, an first shell portion 402 and a second shell portion 404. Each shell portion can include suitable contouring that molds the layers into the crown and brim shapes during the molding process. For example, the second shell portion 404 can include a rounded or convex crown-forming portion 420 that corresponds with the crown of the cap to be formed and a flat or slightly curved brim-forming portion 425 that corresponds with the brim of the cap to be formed. The first shell portion 402 can have a contour that conforms with the lower shell contour such that the layers are molded into the desired cap shape within the mold. In particular, the first shell portion 402 includes a concave crown-forming portion 10 that aligns and corresponds with the convex crown-forming portion 420 of the second shell portion 404 and a flat or slightly curved brim-forming portion 415 that corresponds with the portion 425 of the second shell portion 402, thus defining the profile of the headwear (cap 100) when the upper and second shell portions are pressed together.

Each shell portion can include indentations and/or projections along the interior mold surfaces (i.e., mold surfaces that face each other) suitably aligned and dimensioned to imprint indicia or shapes in the form of raised three dimensional structures and/or grooves or depressions along exterior and/or interior surface portions of the cap (i.e., along exposed surface portions of fabric layer 220 and fabric layer 230). Referring, e.g., to FIGS. 4B and 4C, a molded button 115 and one or more molded creases or ridges 118 (also called fold lines) are formed along the cap 100, and molded U-shaped grooves 125 are also provided that resemble seam lines along the brim 120 (e.g., such that the molded three dimensional features are visible along fabric layer 220) by providing protrusions and/or corresponding depressions at mold surface locations of one or both of the first shell portion 402 and second shell portion 404. The U-shaped grooves 125 formed along the brim 120 of the cap 100 (along an exposed surface portion of the upper layer 220) can be consecutively aligned with each other in a nested configuration or nested pattern (as shown, e.g., in FIG. 1B).

The molded grooves 125 (representing faux seam lines) along the brim 120 are formed by a plurality of consecutively aligned ribs or protrusions 450 located along and extending outward from the mold surface of the first shell portion 402 at the brim-forming portion 415. The ribs or protrusions 450 are curved or arc shaped, thus forming the curved or arc shaped molded grooves 125 along the upper fabric surface of the brim 120 when the cap 100 is formed. The second shell portion 404 can optionally include curved or arc shaped protrusions (not shown) along the mold surface at the brim-forming portion 425 that are suitably aligned with the protrusions 450 of the first shell portion 420 if it is desired to form corresponding molded grooves representing faux seam lines along the lower fabric surface of the brim.

The molded button 115 is formed by providing a curved or concave depression or indentation 430 along the crown-forming surface 410 of the first shell portion 402 and a corresponding curved or convex protrusion 440 aligned along the crown-forming surface 420 of the second shell portion 404. The dimensions of the indentation 430 and protrusion 440 correspond with each other to facilitate formation of the molded button 115 extending a suitable distance from the curved, convex contour of the crown portion of the cap 100.

The brim-forming portions 415, 425 of the upper and second shell portions 402, 404 can have corresponding contours to form the cap 100 so that the brim 120 has a convex curvature transverse the length dimension of the cap (as shown in FIGS. 1A and 1B). In particular, the brim-forming portion 415 of the first shell portion 402 can have a slightly concave curvature that is transverse the length of the mold 400, while brim-forming portion 425 of the second shell portion 404 can have a slightly convex curvature that is transverse the length of the mold and that corresponds in alignment with the concave curvature of the first shell portion 402. This can result in formation of the cap with curved brim as shown in the figures, where the molding process forms a curved shape of the brim that is maintained in such fixed curved shape after the cap has been formed.

The layers can be suitably arranged within the compression mold so as to form the stacked layer unitary structure of the cap as shown, e.g., in FIG. 2A. The molding process for forming a unitary headwear such as the cap 100 as shown in FIGS. 1 and 2 is now described with reference to FIGS. 4A-4E and the flowchart of FIG. 5.

Initially (step 510), the layers used to form the cap 100 are provided having generally planar shapes with cut-out sections forming curved edges and suitable dimensions as previously described herein and shown, e.g., in FIG. 3A. For example, the upper and lower fabric layers 220, 230 can be generally planar and formed (e.g., via knitting, weaving, embroidery, forming nonwoven structures, etc.) and shaped having the curved front edges and rear edge with the cut-out, concave portions. The intermediate (e.g., foam) layer 210 can also be generally planar and formed in the same or similar shape as the fabric layers, while the sweatband layer 320 and/or any other layer is generally planar and shaped in the manner that provides coverage of the layer along an area of the cap as desired. The reinforcement plate 310 can also have a generally planar shape and also the curved edge portion and dimensions as described herein and depicted in FIG. 3A. The material used to form the reinforcement plate can be prepared by injection molding or die cutting (e.g., cutting a TPU plastic material) or forming a solid portion (e.g., solid TPU portion) from a powder composition (heating/fusing the powder composition to form a unitary solid member that is generally flat or has a pre-formed shape).

Figure 4A:
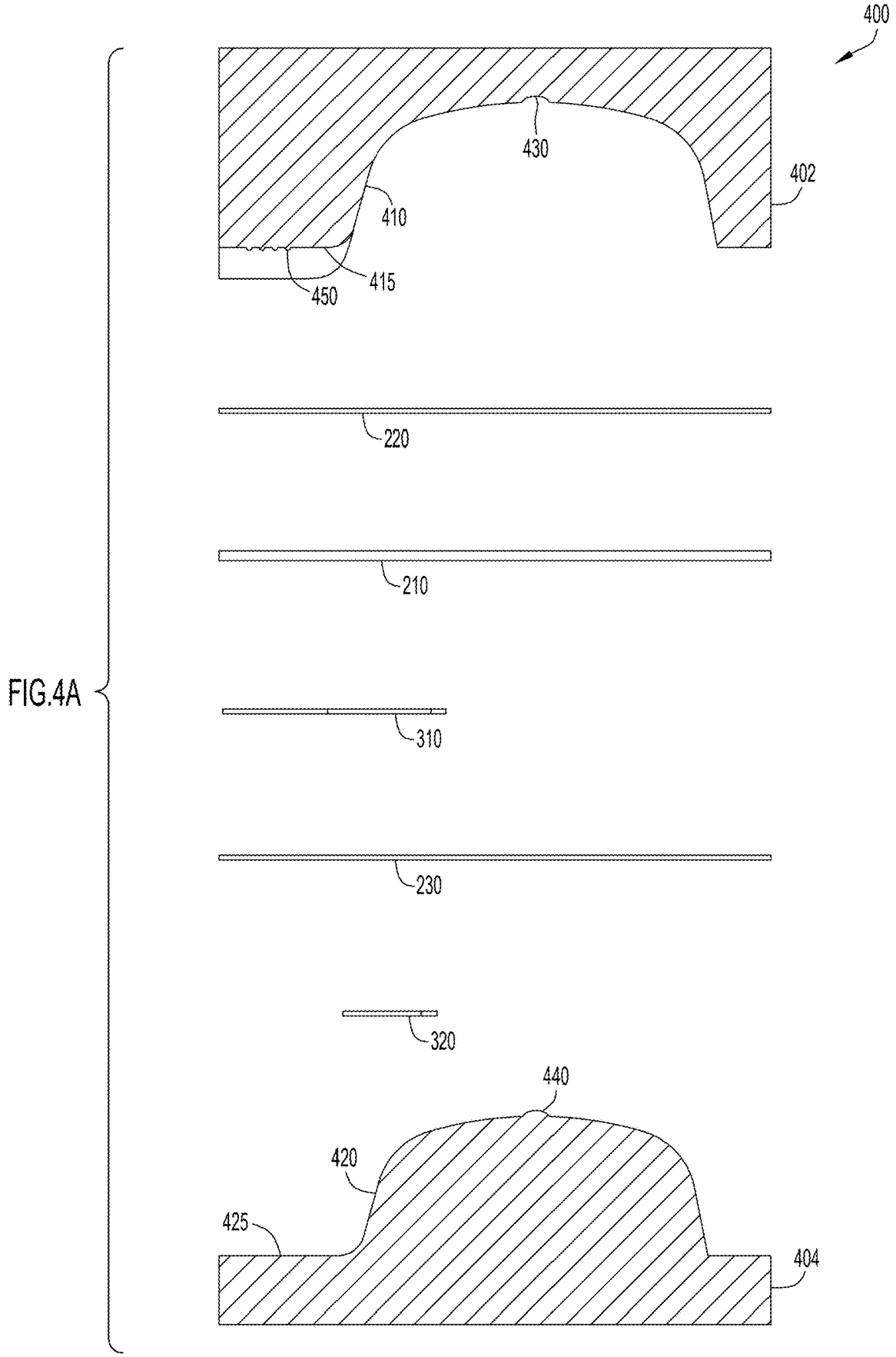
FIG. 4A is a cross-sectional side view of a mold including first and second shell portions separated from each other and material layers stacked in aligned orientation between the shell portions that are used to form the cap of FIG. 1A.
Figure 4B:
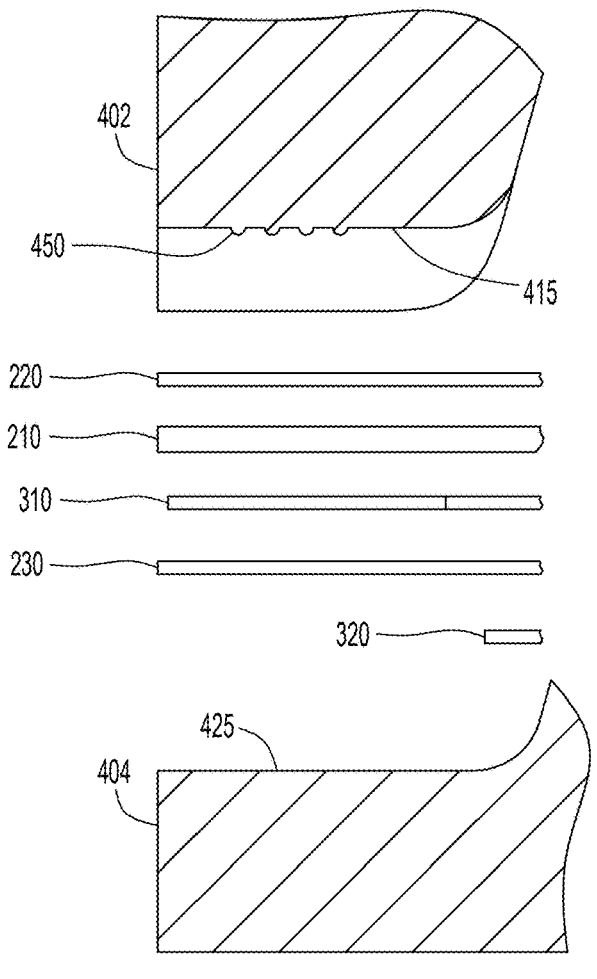
FIG. 4B is an enlarged cross-sectional side view of the mold of FIG. 4A including front end sections of the first and second shell portions which form the brim of the cap.
Figure 4C:
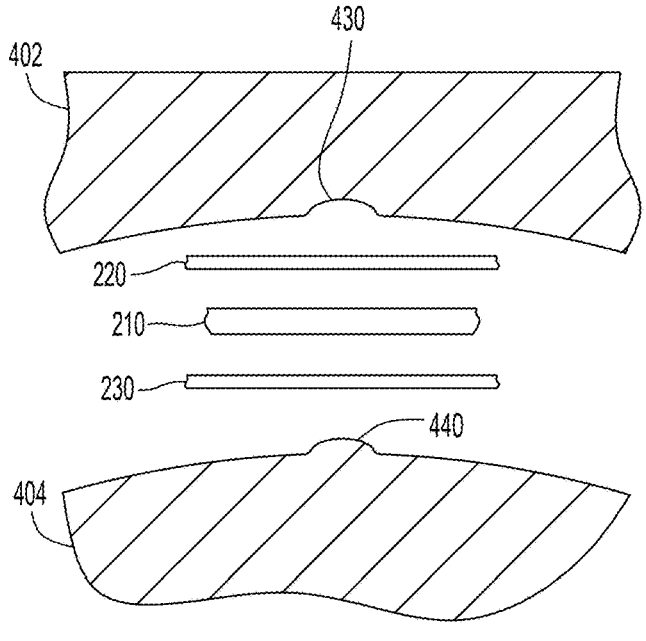
FIG. 4C is an enlarged cross-sectional side view of the mold of FIG. 4A including mid sections of the first and second shell portions which form the apex and a molded button along the crown of the cap.
Figure 5:
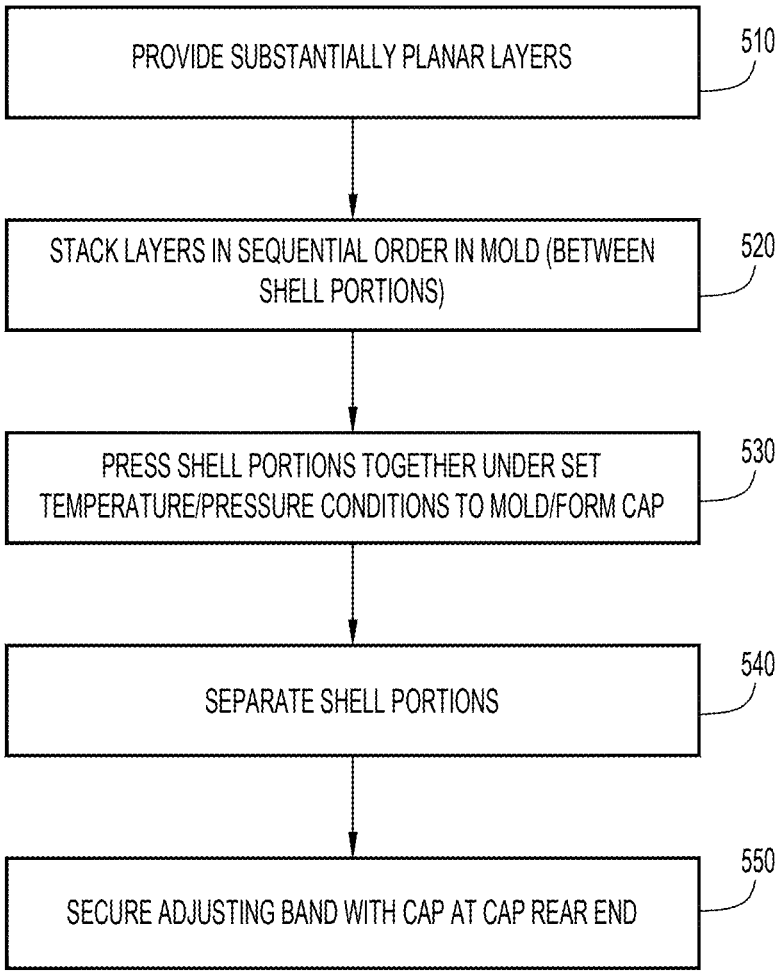
FIG. 5 is a flowchart describing an example embodiment of a molding process for forming a single unitary article of headwear such as the cap of FIG. 1A.

The generally planar layers are stacked within the mold 400 (step 520) and between the first shell portion 402 and the second shell portion 404 as follows, where the sequential order of layers is from second shell portion to first shell portion (as shown in FIG. 4A): Sweatband layer 320, fabric layer 230, reinforcement plate 310, intermediate foam layer 210, and fabric layer 220. The layers can be consecutively laid upon the molding surface of the second shell portion 404 in suitable alignment along the molding surface of the second shell portion and in consecutive order as previously noted starting from interior or head facing side to exterior side of the cap to be formed. It is noted that the stacking of layers upon each other in the designated sequential order can be achieved by placing the layers sequentially upon the second shell portion.

The layers are further placed within the mold in the stacked orientation such that the elongation properties of the layers correspond with the dimensions of the cap to be formed (i.e., elongation properties of one or more of the layers are aligned within the mold so as to correspond with the length and width dimensions of the cap to be formed). For example, the layers can be placed in the stacked orientation within the mold such that at least one of the upper fabric layer, the lower fabric layer, and the intermediate layer has an elongation of about 50% to about 75% in a direction of the mold that corresponds with a length direction of the article of headwear and also has an elongation of about 90% to about 120% in a direction of the mold that corresponds with a direction that is transverse the length direction of the article of headwear.

In the embodiments depicted in FIGS. 4A-4E, the first shell portion 402 is an upper shell portion while the second shell portion 404 is a lower shell portion. However, it is noted that first and second shell portions can also be inverted in relation to each other such that the first shell portion 402 is the lower shell portion and the second shell portion 404 is the upper shell portion. In such an embodiment, the layers could be placed upon the first shell portion 402 with the sequential order of layers being reversed from that which was previously described (i.e., first layer is fabric layer 220, followed by foam layer 210, etc.). The first shell portion, second shell portion and/or one or more of the layers can include suitable markings or designations to arrange at least the sweatband layer 320 and the plate 310 at precise locations in relation to the fabric layers 220, 230 and foam layer 210 within the mold so as to achieve the desired alignment of the layers in relation to each other when molded or fused together during molding. Optionally, the binding material 250 can also be placed in the mold so as to wrap around the peripheral edge portions of the layers prior to the molding process. Alternatively, the binding material 250 can be welded or adhered in any other suitable manner to the peripheral edges of the layers after the cap is formed in the mold.

Figure 4D:
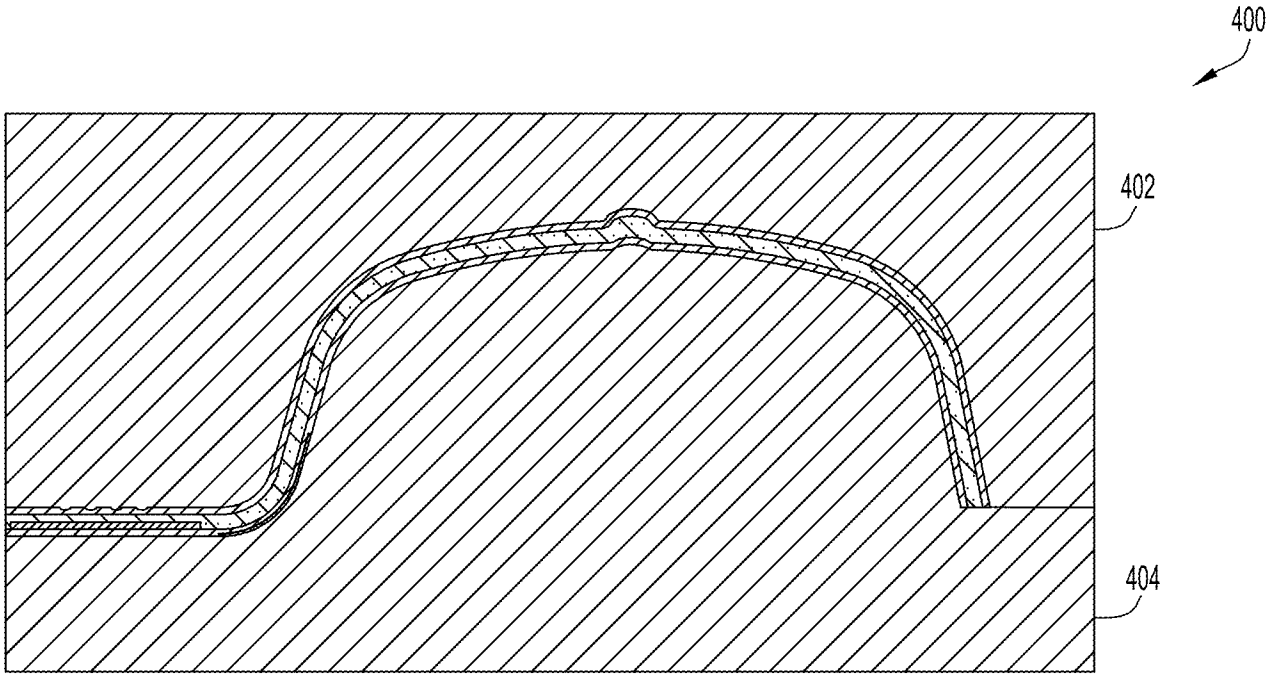
FIG. 4D is a cross-sectional side view of the mold of FIG. 4A with the layers pressed between the first and second shell portions.
Figure 4E:
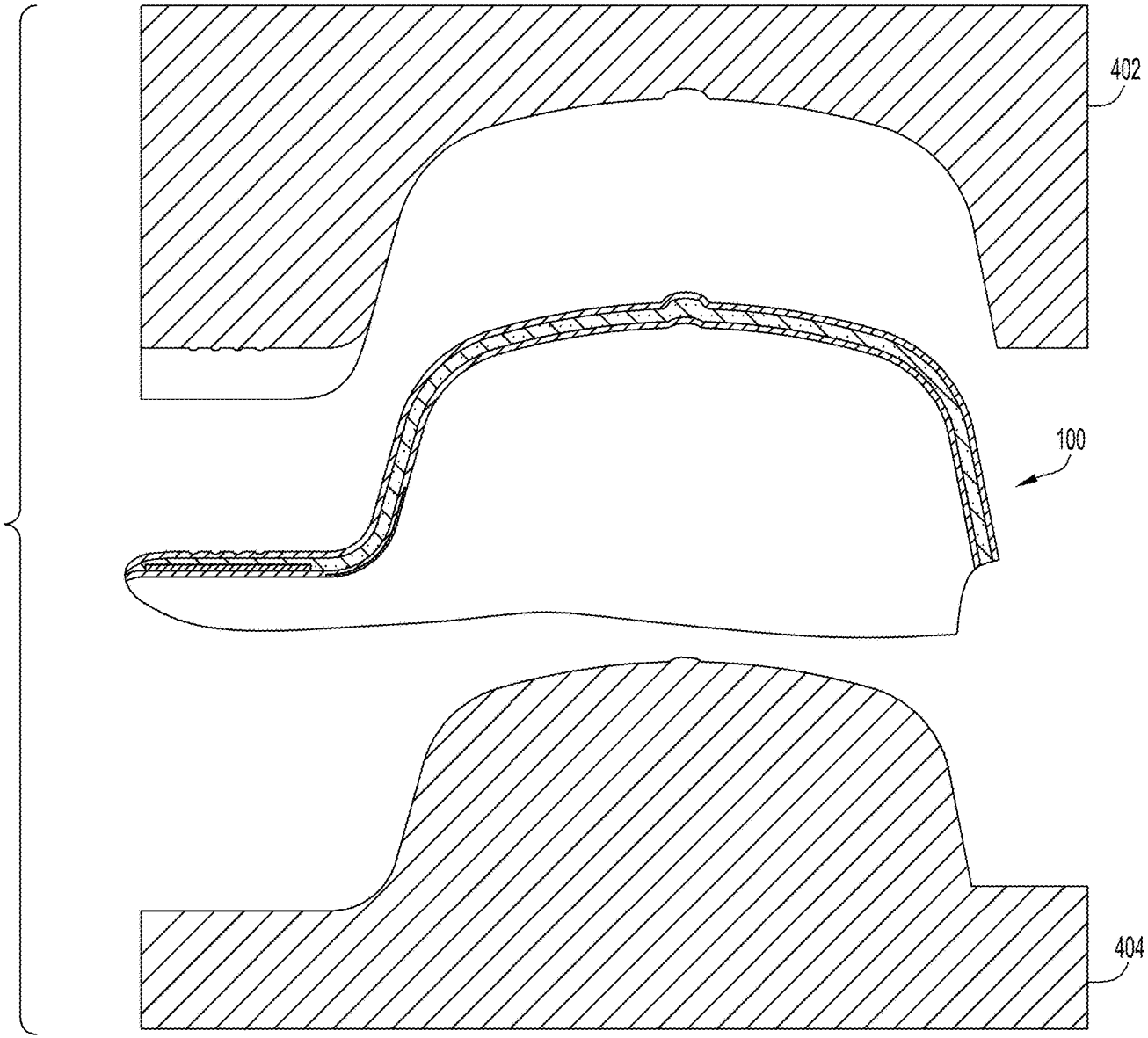
FIG. 4E is a cross-sectional side view of the mold of FIG. 4A in which the first and second shell portions are separated after the molding process shown in FIG. 4D to form the cap of FIG. 1A.

After placement of all the layers in the second shell portion of the mold, the first shell portion 402 is placed over and in suitable alignment with the second shell portion 404, and the upper and second shell portions are forced or pressed toward each other (step 530) with the various layers being pressed together via the facing molding surfaces of the shell portions (FIG. 4D). In the compression process, a suitable compression force and/or suitable heat is applied to the layers within the mold to form the cap comprising a unitary molded member having a three-dimensional shape and including the crown and brim with contours and shape as shown in the figures. In example embodiments, the layers placed in the mold are subjected to heat compression at a temperature of about 150° C., or at least about 175° C., or 200° C. or greater, for a sufficient period of time (e.g., about 120-160 seconds). Example softening temperatures used during the compression molding process can be in the range from about 130° C. to about 200° C. (e.g., about 140° C. to about 190° C.).

The upper and second shell portions 402, 404 of the mold 400 are then separated (step 540), and the layers molded together maintain the form of the molding surface contours within the shell portions to form the cap 100 (see FIG. 4E), including the shape of the crown 110 and brim 120 (brim having curved contour transverse the direction of its length and the cap length). At 550, the band 130 is secured with the cap 100 at its rear end (e.g., via stitching, bonding, etc.). In addition, the binding material 250 can be provided along the outer peripheral edges of the layers forming the cap after the molding process. Alternatively, the binding material can be provided at suitable location(s) in the sequential order of layers within the mold prior to the molding process such that, during molding, the binding material bonds or secures to the layers along the peripheral edges of the cap (thus avoiding an additional processing step, since the binding material can be added in the molding steps).

As a result of the molding process, the layers are pressed, molded and joined or adhered together to define a single, unitary composite structure or textile laminate. As previously noted, the cap that is formed includes layers 210, 220, 230 extending both the full length and width dimensions of the cap 100, such that each cross-section of the cap (extending the full dimensions of the crown 110 and the brim 120) includes each of these layers 210, 220, 230. The molding process compresses and bonds the layers together, resulting in a reduction of thickness of the individual layers after the molding process. Thus, the majority of the cap 100 is formed without any stitches or seams or combinations of separate panels that are combined together and do not extend the full dimensions of the cap. In particular, the outer or exposed surfaces of the cap, as defined by the exposed surfaces of the fabric layers 220, 230, are defined by single material layers. In other words, the cap does not include portions or panels that are stitched together or have exterior seams along a majority of the exposed surfaces areas of the cap. Further, the crown and brim portions of the cap are thus also formed of a single, unitary composite structure (i.e., the crown and brim are not separate components connected to each other via any stitching or seams).

The compression molding process forms a contoured portion of the headwear that is shaped in the form of the mold portions, and which holds and maintains its shape. In particular, a single molded body defining a curved brim portion and an annular or dome-shaped crown portion are formed via the compression molding process, with the same or different number and/or types of material layers.

The materials used to form the cap, including the intermediate foam layer 210, and the upper and lower fabric layers 220, 230 which extend substantially the entire length of the cap (from front end of cap/front edge of brim 120 to rear end of cap/rear end of crown 110), combined with the molding process that forms the cap as a substantially unitary molded member (instead of crown and brim being separate members that are connected with each other), results in the cap having a very flexible shape with "memory" or shape retention that facilitates orientation of the cap substantially into its original shape and configuration after being bent or deformed in any number of compressed configurations.

For example, the cap can be compressed or bunched into the shape of smaller space or volume, such as a ball (e.g., compressing portions of the cap together using one or a pair of hands) or folded in any one or number of folds (e.g., so as to fit within a small compartment or space, such as a coat or pants pocket) and the cap remains held with a holding force that keeps the cap in such compressed configuration. Upon release of the compression force upon the cap (e.g., cap is removed from the compartment or pocket), the cap expands and/or re-orients into its original (i.e., originally molded form) configuration. This facilitates easy storage and transport of the cap when not in use, and the flexibility of the cap allows for ease of conformity in expanding or contracting (e.g., when using the adjusting band 130) around the head of a wearer regardless of different head sizes and shapes.

When utilizing textile material layers (e.g., the upper and lower fabric layers and/or one or more intermediate fabric layers) including fusible and/or non-fusible yarns, as a result of the molding process the fusible yarns fuse or bond with other fusible yarns and/or non-fusible yarns at selective crossing yarn locations along the textile material layer(s). This results in a stiffening of the textile material layer(s) which provides structural integrity for the headwear/cap and can also enhance its "memory" or shape retention features, i.e., biasing the cap (or other headwear) into its original shape that was formed from the molding process even after significant deformation of the cap from its original shape.

In addition, in embodiments where at least the reinforcement plate includes perforations or through-holes (e.g., plate 310A or plate 310B), portions of an intermediate layer (e.g., foam layer 210) can be forced to extend within or even partially through the through-holes as a result of the molding process (as shown, e.g., in FIG. 3C) so as to firmly affix the reinforcement plate within the brim of the cap.

Conventional caps include the crown portion and cap portion as separate sections that are secured together to form the cap. This typically results in many layers being folded over at the join or connection between brim and crown. This further results in one or more hard seams or edges that form on the interior surface of the cap at the transition between brim and crown (due to the combination of many layers required to connect brim with crown), and this transition is further located at a position which corresponds with the forehead of the wearer of the cap. This can lead to irritation and discomfort for the wearer due to this hard seam/hard edge contacting the wearer's forehead. In contrast, the unitary cap formed by the molding process as described herein includes no folded over layer at the transition between brim and crown (i.e., the layers extend continuously through the transition between brim and crown, with no folding over/no seams/no hard edge existing at this transition).

The compression molding process can further include mold portions having patterned depressions and/or protrusions that, when forming the fabric laminate, define a corresponding "mirror image" pattern of depressions and/or protrusions along a surface of the fabric laminate that defines an exterior surface portion of the headwear. This facilitates the formation of macrostructure (the dome formation of the crown and curvature of the brim) and/or microstructures on inner and/or outer surfaces of the headwear. For example, the crown portion and/or brim portion can include an external surface pattern that forms an uneven contour of indentations and/or raised ridges. For example, protrusions can be formed at outer surface portions of the headwear, via the compression molding process, providing functional or decorative shapes in specified areas of the headwear. When disposed on the inner surface of the headwear, the protrusions can function as spacers to create air gaps or channels between the headwear and the foot of the user, enabling airflow within the channels. The protrusions are integrated into the headwear, being formed as the result of the shape of the mold portions. The protrusions may be any size and shape suitable for their described purpose and may be disposed in any predetermined pattern along a portion of the headwear, or along the entire headwear.

In particular, one or both of the upper and second shell portions of the mold can include depressions, indentations and/or projections at suitable locations so as to imprint corresponding features along exterior surface portions of the cap during the molding process. In the example embodiment of the cap of FIGS. 1 and 2 and the mold of FIG. 4, the first shell portion of the mold includes a suitably dimensioned rounded or concave depression (FIG. 4C) that facilitates formation of the molded button 115 at the top of the crown 110 for the cap 100 during molding. The molded button 115 is defined by portions of the upper fabric layer 220 and the intermediate foam layer 210 that are pressed into the depression or indentation 430 along the molding surface 410 the first shell portion 402 of the mold during the molding process. As shown in FIGS. 2A and 2B, the molded button 115 can be formed via the molding process such that all three layers (upper fabric layer 220, intermediate foam layer 210, and lower fabric layer 230) are all deformed to form a curved, convex protrusion along their corresponding upper (i.e., top facing) surfaces that define the molded button 115 (i.e., upper convex surfaces 221, 211 and 231 of the upper fabric layer 220, intermediate foam layer 210, and lower fabric layer 230, respectively, as shown in FIG. 2B). In addition, the lower fabric layer 230 includes an exposed concave surface 233 at the location of the molded button 115. These convex and concave surface are formed as a result of the corresponding convex protrusion 440 along the molding surface of the second shell portion 404 forcing the layers into the indentation 430 of the first shell portion 402. Thus, the curvature formed in the layers 220, 210, 230 caused by the molding process forms the molded button 115 having a dome or raised, e.g., hemispherical, three dimensional shape along an exposed portion of the upper layer 220 (e.g., at or near the apex of the crown 110).

Similarly, the molded grooves 125 along the upper surface of the brim 120 of the cap 100 are formed during the molding process by the protrusions 450 along the brim-forming portion 415 of the first shell portion 402 pressing into the upper surface of at least the upper fabric layer 220 when the shell portions 402, 404 are brought together. The combined pressure and heat create these indentations that remain after the shell portions are removed from the formed cap, thus defining the arc or curved molded grooves 125 along the upper surface of the brim 120 (as shown, e.g., in FIG. 1A).

The features of the molded button 115 at the crown 110 and molded grooves 125 at the brim 120 creates a visual effect that resembles conventional caps in which a button is connected (e.g., stitched or adhered) to the upper surface of the crown of the cap and stitches forming seam lines are provided in a curved manner along the brim. Similarly, eyelets 116 and molded or panel ridges 118 that mimic seam lines can be formed during the molding process in at least the surface of the upper fabric layer 220 at locations along the crown 110 to provide features that create a visual effect for the cap that is similar to conventional caps which include actual panel seam lines and/or eyelets. These additional features can also be created by providing suitable protrusions and/or indentations within either or both of the upper and second shell portions to achieve the desired formation along portions of the cap. For example, an eyelet 116 can be created along the crown 110 using a punch type protrusion along one or both of the shell portions of the mold so as to pierce one or more layers of the cap when the shell portions are brought together and the molding process at the suitable pressure and temperature creates an opening through the crown (thus forming the eyelet). While not shown, additional eyelets or apertures can also be provided along portions of the brim of the cap (e.g., to provide airflow through the cap at selected locations).

Thus, the eyelets 116 can be actual through-holes or perforations that extend through at least the upper fabric layer 220 (and possibly even into and/or through one or both of the intermediate foam layer 210 and the lower fabric layer 230). The perforations formed in one or more layers of the cap can provide suitable venting (e.g., air ventilation) for the cap to enhance airflow and heat transfer (e.g., cooling) between the head of the wearer and the surrounding environment. As previously noted, the reinforcement plate 310 can include perforations to permit ventilation/airflow through the plate. Such perforations can extend not only through the plate 310 but also through other layers (e.g., layers 220, 210, 230), where the perforations are in communication to permit ventilation or air flow entirely through the brim 120 via the perforations. Slightly raised projections or ribs (e.g., arc shaped ribs) can further be provided at suitable locations along the first shell portion which imprint arc shaped grooves in the brim 120 to define molded grooves 125 that resemble and provide a visual effect of actual seam lines that are present in the brims of conventional caps.

The combination of materials used to form the cap, including fabric and foam materials, as well as the air vents (e.g., eyelets formed in the crown and/or any other vents, such as vents in the brim) and manner in which layers are formed (no stitching or seams or folded over layers) can impart an effective airflow through the cap to enhance thermal transfer (e.g., cooling) between the head of the wearer and the surrounding environment during cap use. In certain example embodiments, the cap can include any suitable number of vents extending through all layers of the cap (i.e., extending between and through all layers including the upper fabric layer, intermediate foam layer, and the lower fabric layer) along the crown and/or the brim so as to impart an airflow/breathability for the cap of at least about 200 CFM (cubic fee per minute), or at least about 250 CFM, or at least about 300 CFM, or at least about 350 CFM or greater, or even at least about 375 CFM or greater. This is greatly enhanced compared to conventional caps that typically allow a breathability of around 50 CFM.

Compression molding permits formation of a brim portion possessing different mechanical properties than the crown portion. Compression molding further permits forming headwear components possessing a unibody (one piece) construction that is seamless and stitchless (e.g., does not include individual components secured together via stitching).

In addition, the mold and molding process as well as the material layers used to form the cap as described herein can impart to the unitary cap a rounded transition that facilitates flexing of the cap at the transition between brim and crown so as to reduce pressure spots of contact between the cap and wearer forehead when the cap is worn.

In conventional caps, particularly caps in which the brim and crown are separate components that are connected to each other, the transition region between brim and crown is typically defined by an angle (measured along a lengthwise cross-section of the cap) of about 90°. The connection at the transition between brim and crown is also very rigid, with little or no ability for the cap to flex at the transition region when the cap is worn by different wearers with different head shapes.

Figure 6:
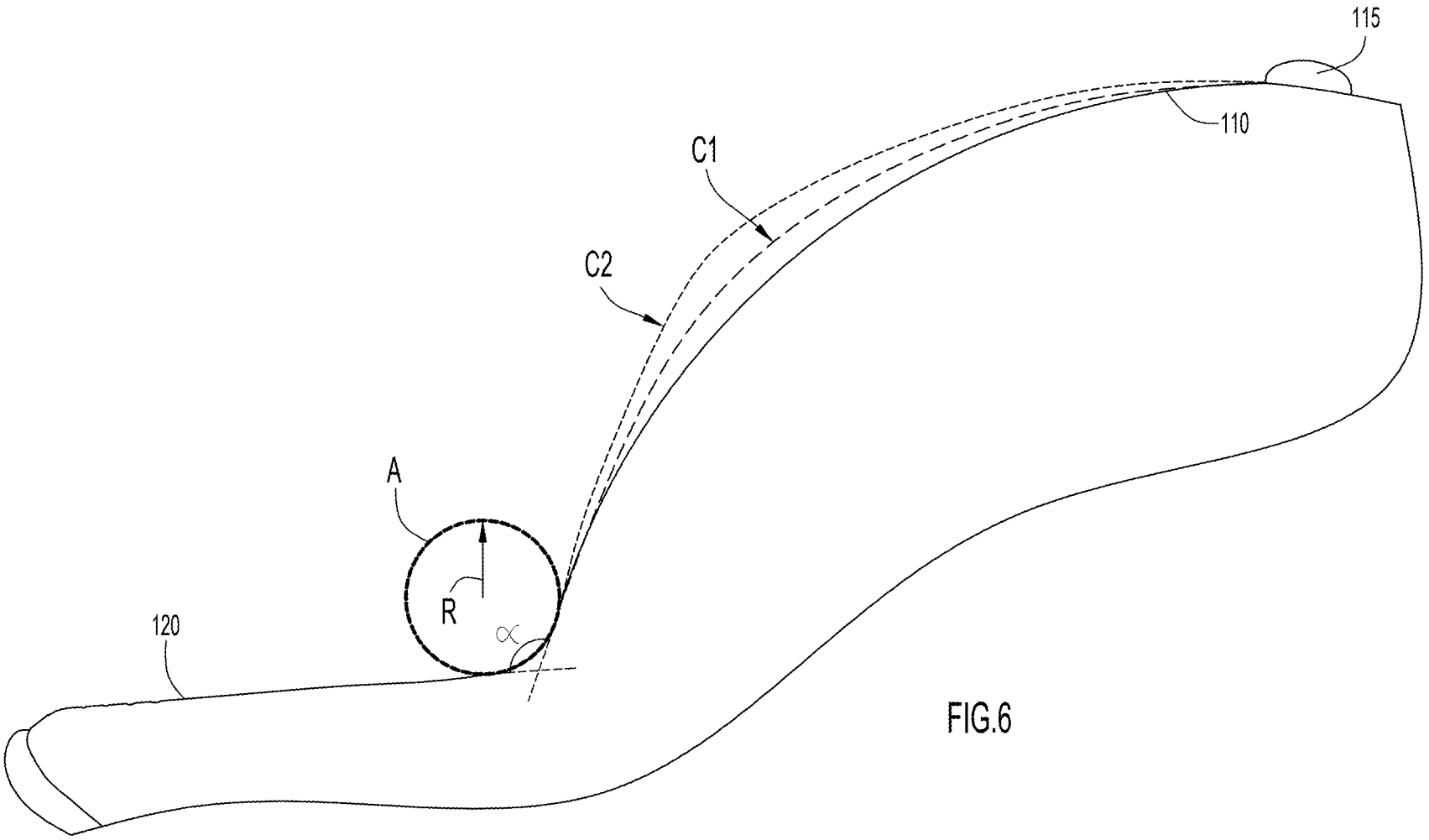
FIG. 6 is an enlarged cross-sectional side view of a portion of the cap of FIG. 1A showing the transition region between brim and crown of the cap and how the crown flexes to conform to varying head sizes.

In the molded cap 100 formed as a unitary structure, the cap can be formed such that the transition region between brim 120 and crown 110 is defined by an angle that is obtuse (much greater than 90°) and rounded. Referring to FIG. 6, the transition region is generally defined by angle between brim 120 and crown 110 that is shown by the dashed lines along the upper fabric layer 220, where the transition angle $\alpha$ is at least about 100°, or at least about 110°, or at least about 120°, or 130° or even greater. The transition region is further rounded and defined by a portion of a circle A (i.e., the rounded transition region is tangent to the circle A), where the radius R of circle A is about 3 mm or greater, e.g., from about 5 mm to about 20 mm.

The combination of the transition region having a rounded configuration defined by an obtuse transition angle along with the various layers being continuous at the transition region (i.e., no folded over seams or edges) facilitates a suitable level of flexibility in the cap at the transition region. This results in a degree of flexure of the cap along the transition region (shown by the phantom dashed lines C1 and C2 in FIG. 6, showing deformation of flexing of the crown 110 at or along its front end from its join with the brim 120 to the button 115) to align and conform the cap with the forehead of the wearer while minimizing or preventing pressure points from developing against the wearer's forehead. This is further demonstrated with reference to FIGS. 7A, 7B, 8A and 8B. These drawings schematically depict how the brim of a conventional cap (FIGS. 7A and 7B) conforms to different head sizes/shapes (labeled as narrow, standard and wide) in comparison to how the brim of the cap of FIG. 1A (FIGS. 8A and 8B) conforms to the same or similar head sizes/shapes.

Figure 8A:
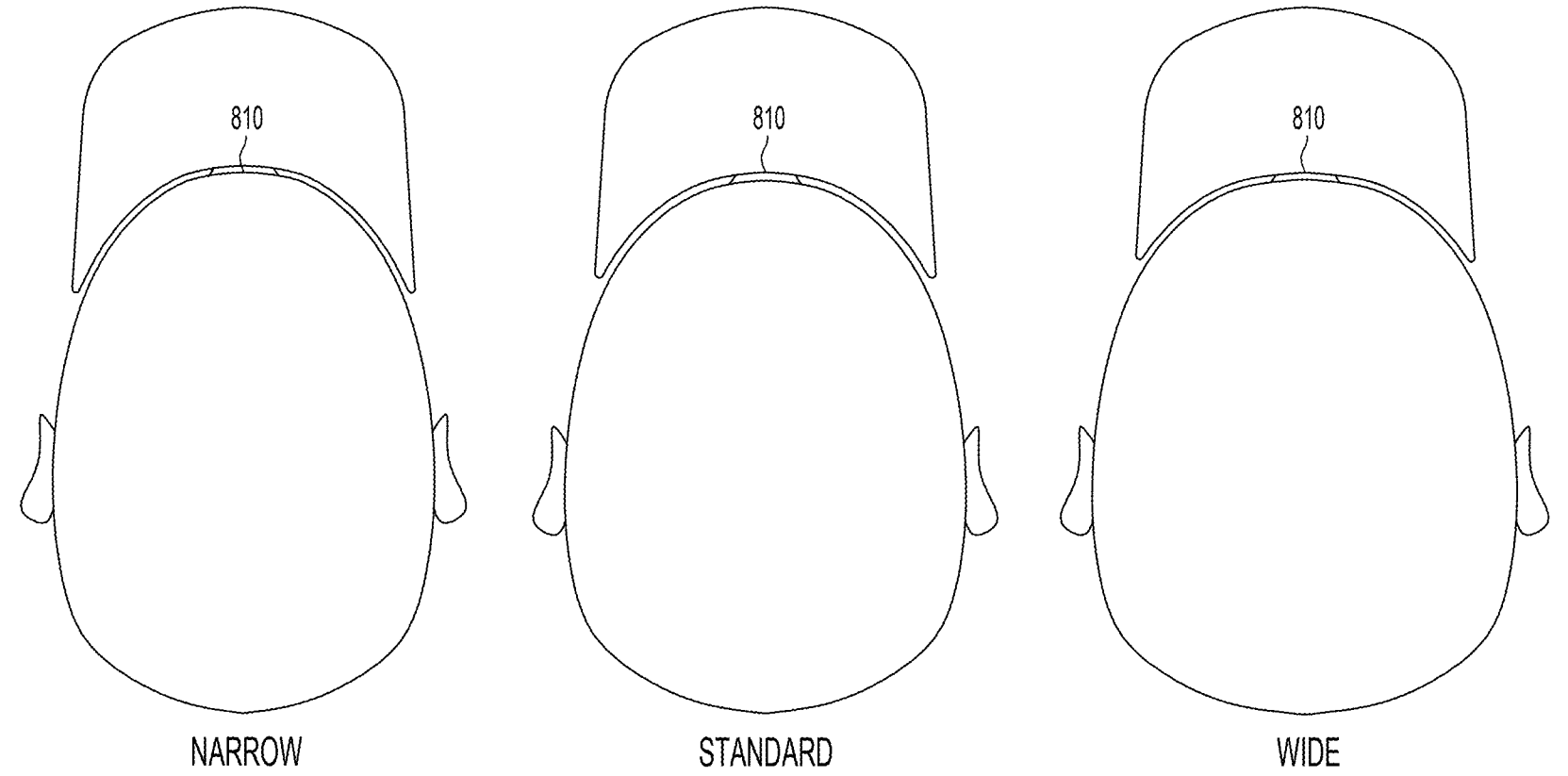
FIG. 8A depicts schematic top views in plan of the brim for an article of headwear (e.g., the cap of FIG. 1A) as described herein that is worn by wearers having different head sizes (narrow, standard and wide).
Figure 8B:
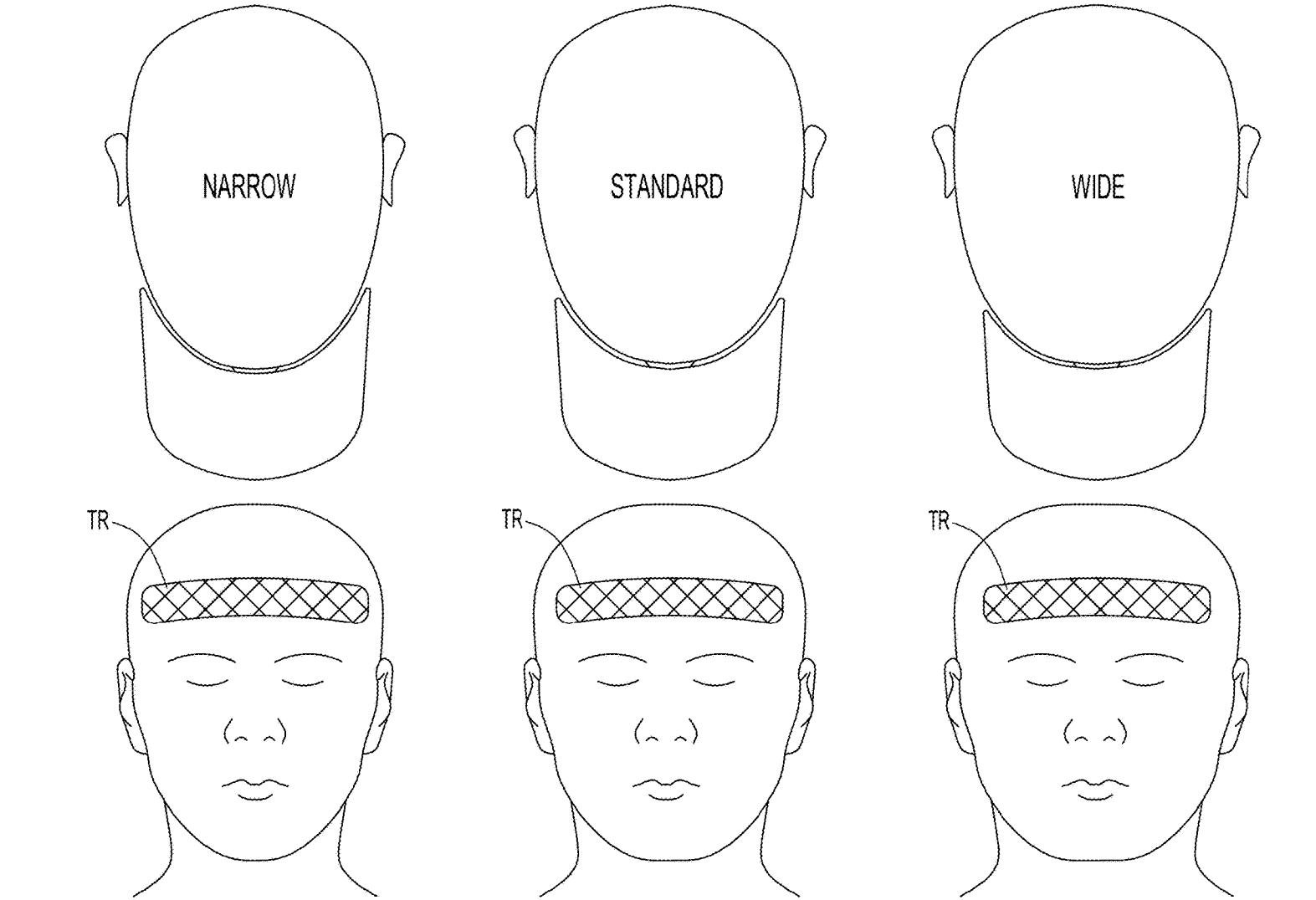
FIG. 8B depicts schematic views (top views in plan and front views in elevation) of the brim against different head sizes as shown in FIG. 8A and how the brim as described herein conforms to the different head sizes and minimizes or eliminates hard edges/pressure points on the forehead of the wearer at the transition region between brim and crown and regardless of head size/head shape.

As shown in FIG. 6 (phantom dash lines C1, C2 representing changes in contour of crown) and also FIGS. 8A and 8B, the crown 110 and/or the brim 120 of the cap 100 can deform or change in shape slightly to conform with different sized heads of wearers. Further, the transition region between brim 120 and crown 110, as defined by an arc curvature 810 extending between sides of the cap that are transverse the front and rear sides of the cap (see FIG. 8A), can deform or change in arc angle when the cap is worn by wearers having different head sizes and/or shapes (e.g., resulting in stretching of brim and/or crown to fit different heads sizes/shapes).

Figure 7A:
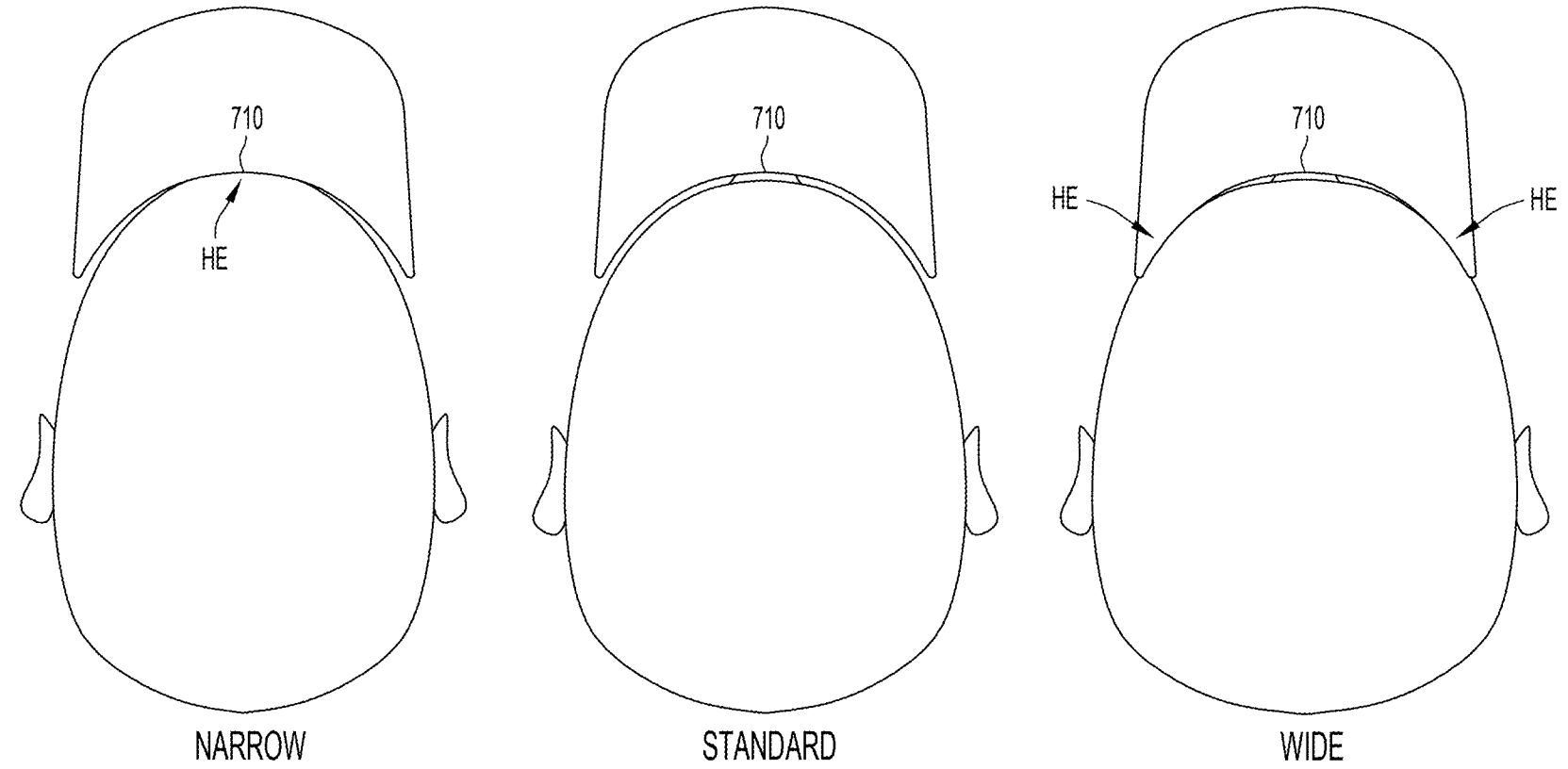
FIG. 7A depicts schematic top views in plan of how a brim for a conventional cap conforms to different head sizes and shapes (narrow, standard and wide).
Figure 7B:
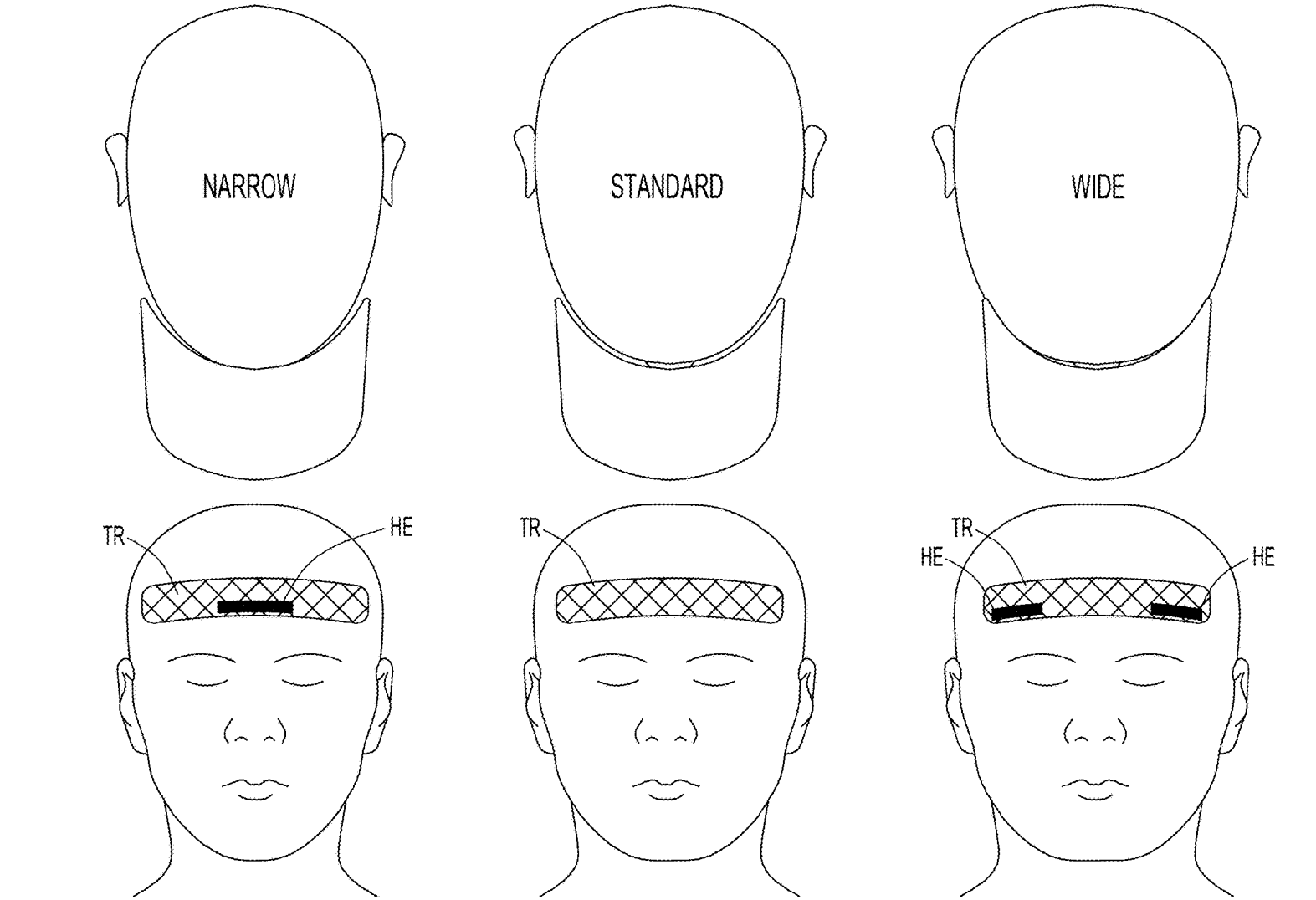
FIG. 7B depicts schematic views (top views in plan and front views in elevation) of the brim of a conventional cap against different head sizes as shown in FIG. 7A and how the brim can impart hard edges or and pressure points along the forehead of a wearer at the transition region between brim and crown of the cap.

Referring to FIGS. 7A and 7B, a conventional cap can create hard edges or pressure points that apply greater pressure to the forehead of a wearer depending upon the head size/shape of the wearer. This is due to the relative inflexibility or inability of the crown and/or the brim to flex, particularly along the arc defined at the transition region between crown and brim (shown as curved line 710 in FIG. 7A, where the arc is in the same plane as the brim, and further as TR in FIG. 7B), based upon different head sizes/shapes. Regardless of the shape of the forehead of the wearer, the shape of the arc curvature or arc angle defining the transition between brim and crown of the conventional cap remains relatively constant or changes very little when the cap is worn.

For example, for a narrow head, a hard edge/greater pressure might be applied to the forehead of a wearer at the front of the wearer's forehead due to the inability of the cap to conform around the narrow shape of the head (see FIGS. 7A and 7B, identified as HE). For a wide head (also shown in FIGS. 7A and 7B), the outer sides of the arc defined the transition region between brim and crown provide a hard edge/greater pressure (identified as HE) along opposing side surfaces of the wearer's forehead (e.g., two pressure points at forehead sides). The resultant hard edge contact points of the cap along certain wearer foreheads can create abrasion, chafing, discomfort and (in some scenarios) even headaches for the wearer.

In contrast, the molded, unitary cap as described herein and depicted in FIG. 1A is capable of sufficiently flexing (due at least in part to the continuous fabric and foam layers and the obtuse transition angle $\alpha$ defined at the transition region between brim and crown), where the arc curvature or arc angle (curved line 810 as shown in FIG. 8A, where the arc is in the same plane as the brim) defining the transition region (shown at TR in FIG. 8B) between brim and cap changes slightly, when the crown of the cap is stretched as the cap is fit onto and worn by wearers having different head sizes/shapes. In particular, the arc angle defining the transition region between brim and cap can change by at least about 5°, or at least about 10°, or at least about 15°, or at least about 20° or greater (as shown by the changing contours C1, C2 of the crown 110 at its front side as shown in FIG. 6). This results in minimal or reduced pressure points or hard edges forming against the wearer's forehead along this arc angle (see FIG. 8B, no hard edges or pressure points along transition region TR between brim and crown for the different head sizes/shapes), since a relatively soft and constant force is applied by the cap at the brim/crown transition where the cap faces and engages portions of the wearer's forehead due to the deformation and flexure of the crown and/or brim to conform to the head shape of the wearer. In particular, due to the features of the molded, unitary cap, the amount of pressure that might be applied to a wearer's forehead can be reduced by at least 50% when compared to conventional caps. Further, and as previously noted, the elimination of any seams, stitches and/or folded layers at the transition between brim and crown minimize any abrasive or hard contact against the wearer's forehead.

Thus, the molded, unitary cap described herein accommodates multiple head sizes without sacrificing comfort. The continuous fabric and foam layers and entirely seamless configuration at the transition region between brim and crown of the cap along with the obtuse transition angle provided at the transition region facilitates easy flexure of the cap to conform with varying head sizes, resulting in change in the arc curvature or arc angle defined along the plane of the brim at the transition between brim and cap. This results in a comfortable fit for wearers regardless of head size/shape with minimal or no pressure points applied by the cap to the forehead of the wearer.

While the headwear and method of forming the headwear as depicted in FIGS. 1-6 comprises a cap with a full crown and brim, it is noted that other embodiments of the headwear can also be formed including a some portion of the headwear, including brim and (partial or full) crown portion being formed of a single, seamless and unitary member with fabric and intermediate (e.g., foam and/or other) layers) extending substantially the entire length of the brim and crown portion. For each headwear embodiment, the brim and crown portion are molded as a single unitary member with a plurality of layers extending continuously along brim to crown portion and defining the transition region therebetween, where the brim and crown portion are constructed and configured so as to provide the same or similar benefits and effects as the cap of FIG. 1A in the transition region with regard to conforming and providing a comfort fit with reduced or no hard edges/pressure points on the forehead of the wearer when the headwear is worn.

Figure 9:
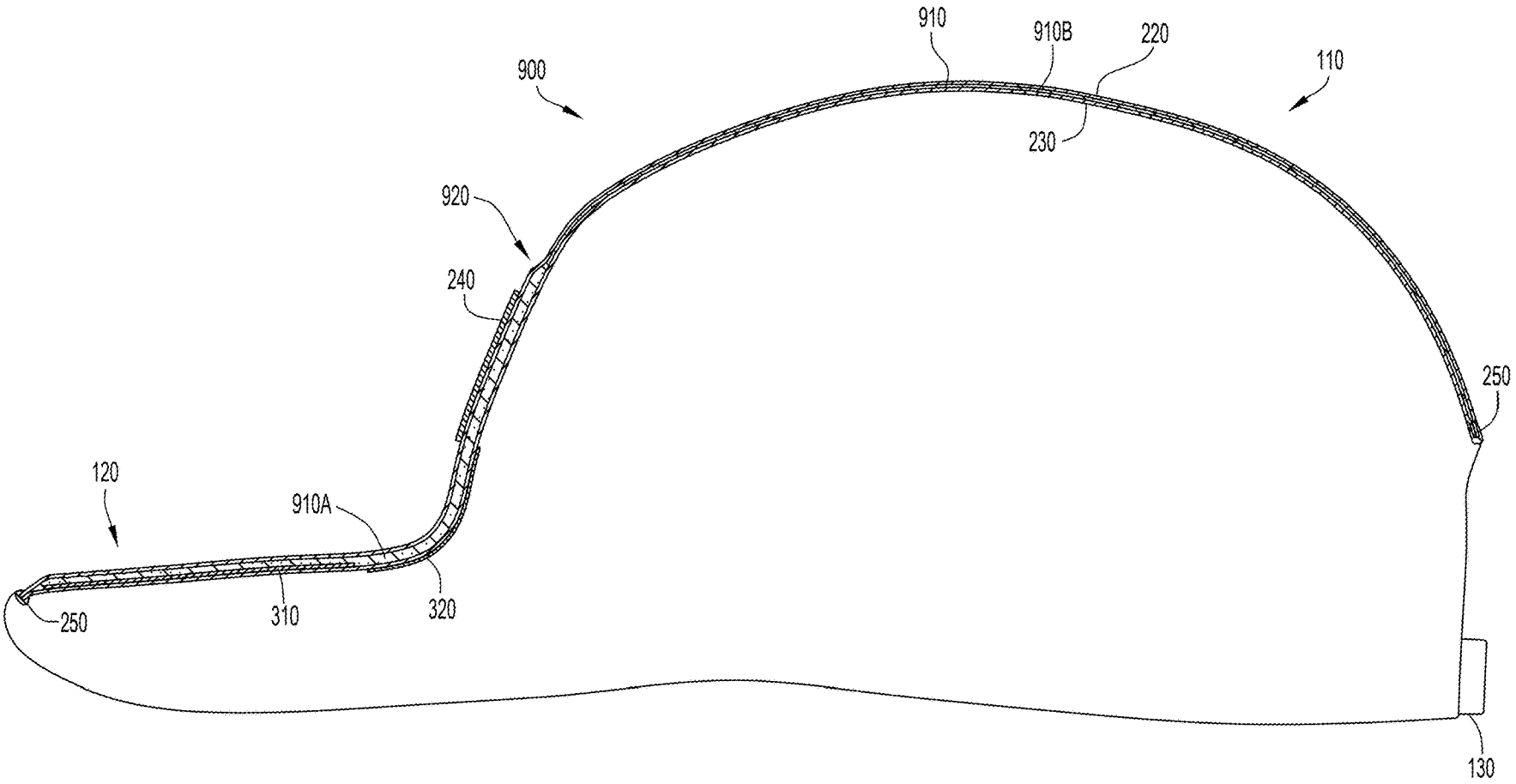
FIG. 9 is a cross-sectional side view of another embodiment of an article of headwear in the form of a cap that is similar to the cap of FIG. 1A but having an intermediate foam layer that varies in thickness.

Referring to the example embodiment of FIG. 9, a cap 900 comprises a unitary molded member comprising a crown 110 and a brim 120 having a similar configuration and layers forming the cap as those previously described and depicted in FIGS. 1-2 and which continuously extend from a front end to a rear end of the cap. However, cap 900 is slightly modified from cap 100 in that the intermediate layer 910 (e.g., foam layer) has a thickness that varies along its length as layer 910 extends from the front end of the cap 900, at the brim 120, to the rear end of the cap 900, at the rear end of the crown 110. In particular, the intermediate layer 910 changes in thickness at a thickness transition region (identified by arrow 920) along a portion of the crown 110 at a location between the transition region between brim 120 and crown 110 and prior to reaching the highest point or apex of the crown (e.g., prior to a location at which a molded button may be located). The embodiment of FIG. 9 also does not include any molded button or molded grooves resembling seam lines. However, these can also be provided as optional features for the cap 900.

The thickness of the intermediate layer 910 decreases at the thickness transition region 920 such that a first portion 910A of the layer 910 (which extends from front end of the cap 900 to the transition region 920) is greater than a thickness of a second portion 910B of the layer 910 (which extends from the transition region 920 to the rear end of the cap 900). The thickness of the first portion 910A can be at least 25% greater, or at least 30% greater, or at least 40% greater, or at least 50% or greater, or even at least 75% greater than the thickness of the second portion 910B. This change in thickness of the intermediate layer 910 may be provided, e.g., to ensure structural integrity at the brim and transition region between crown and brim, while reducing overall thickness of the crown over a major or significant portion of the crown that covers the wearer's head (e.g., greater than 50% of the area covering the wearer's head). This can enhance heat exchange/air flows between the head of the wearer and the surrounding environment in addition to other heat exchange (e.g., cooling) features already associated with the headwear.

Figure 11:
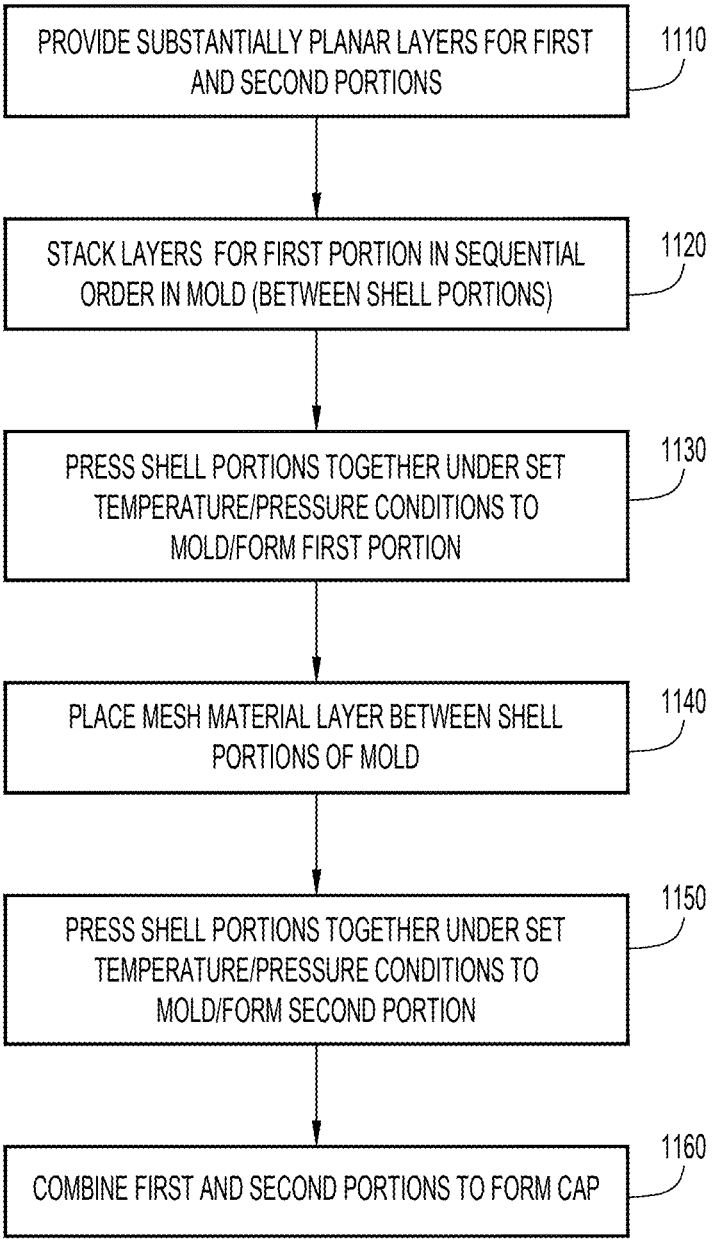
FIG. 11 is a flowchart describing an example process of forming an article of headwear (e.g., the cap of FIG. 10A) by molding two portions and then combining the two portions together.

In another embodiment depicted in FIGS. 10A and 10B, headwear in the form of a cap is formed by combining two molded pieces and in accordance with a method as shown in the flowchart of FIG. 11. The cap 1000 includes a first portion 1010 including the brim 120 and a front portion of the crown 110 and a second portion 1020 including the rear portion of the crown 110. The front portion includes a plurality of layers 220, 210, 230, 310, 320 that are the same or substantially similar to the layers forming cap 100 with regard to materials of construction, alignment and orientation along portions of the cap. However, it is noted that the upper and lower fabric layers 220, 230 and the intermediate layer 210 are truncated in length and do not extend substantially the entire length of the cap (from front to rear end). Instead, each of these layers 220, 230, 210 extends the entire length of the first portion 1010, where the first portion 1010 extends from the front end of the cap 1000, the entire length of the brim 120 and along the transition region between brim 120 and crown 110, to a location at or near the highest point or apex of the crown 110 and at or near molded button 115. The molded button 115 is also formed via molding in the same manner as described for the embodiment of FIGS. 1-6 and preferably is formed as part of the first portion 1010. Thus the first portion 1010 is formed via molding from a series of generally planar layers that, upon molding, form the shape of the brim and first portion of the crown.

The second portion 1020 can comprise a single layer 1025 of material. The single layer 1100 can comprise a fabric or textile layer. Alternatively, the layer 1025 can comprise a laminate or other suitable layer. In the embodiment of FIGS. 10A and 10B, layer 1025 comprises a mesh material layer, i.e., a material layer including mesh openings or apertures of a suitable mesh size to facilitate greater breathability and airflow through the material layer. The mesh material layer can initially have a generally planar configuration, where the molding process results in the layer 1025 forming the curved crown configuration of the second portion 1020. Fusible and/or non-fusible yarns can also be provided to form the mesh material layer 1025 depending upon whether it is desired to impart and/or enhance a degree of stiffness for the mesh material layer after it has been molded into the crown shape for the second portion 1020.

The cap 1000 can be formed in a molding process in which two parts, first portion 1010 and second portion 1020, are molded and combined together. The two parts can be separately molded and then combined (e.g., via stitching, bonding, using seam tape to secure the two portions together, etc.). Alternatively, the two parts can be molded and combined together in the same molding process. Further, binding material 250 can be provided for the cap 1000 in a manner similar to that described for the embodiment of FIGS. 1-6), where the binding material 250 encloses and binds together the layers of the first portion 1010 together at the peripheral edge locations of the first portion and further extends around the peripheral edge portions of the second portion 1020 in a continuous manner between both portions 1010, 1020 so as to further secure these two portions together after they are molded in their shapes and combined.

Referring to FIG. 11, an example embodiment of a process for forming cap 1000 is now described. The generally planar layers used to form the first portion 1010 are initially provided in configurations similar to those depicted for the cap of FIGS. 1-6, with the exception that layers 210, 220, 230 are reduced in length as previously noted. Next, these layers are placed or stacked in proper sequential order between upper and second shell portions of a mold (step 1120) (e.g., in a configuration similar to that depicted in FIG. 4A). The shell portions are forced or pressed toward each other (step 1130) with the various layers being pressed together via the facing molding surfaces of the shell portions (similar to that shown in FIG. 4D).

The generally planar mesh material layer used to form second portion 1020 is placed within a mold (step 1140) with upper and second shell portions having a similar configuration to that which is shown in FIG. 4A. These shell portions could also be the same as those used to form the first portion 1010. In such an embodiment, a first section including a front end of the mold would be used to form the first portion of the cap, while a second section including a rear end of the mold would be used to form the second portion of the cap. The shell portions of the mold can include indicia or markings that facilitate alignment of the various layers for the first portion of the cap within the mold as well as alignment of the mesh material layer in the mold for forming the second portion of the cap. The shell portions with the mesh material layer disposed therebetween are pressed together (step 1150) under suitable temperature and pressure conditions to form the shape of the mesh material layer into the second portion 1020 of the cap 1000.

The molded first portion 1010 and the molded second portion 1020 are combined together (step 1160) to form the cap 1000 of FIGS. 10A and 10B. As previously noted, the first and second portions can be combined and secured together via stitching, seam tape, welding and/or any other suitable process. In addition, the binding material 250 can be provided and secured (e.g., via stitching, welding and/or other form of bonding) along the peripheral edge portions of the first and second portions as they are aligned with each other so as to provide further binding of these two molded portions to each other.

As previously noted, in an alternative to the process described by the flowchart of FIG. 11, the molding of the first and second portions forming the cap can be achieved in the same molding process or at the same time. For example, the series of generally planar layers forming the first portion 1010 can be placed within the mold and aligned at a forward biased location of the upper and second shell portions, while the generally planar mesh material layer forming the second portion 1020 can be placed within the mold and aligned at a rearward biased location of the upper and second shell portions. Facing edge portions of the mesh material layer 1025 and layers 220, 210, 230 can slightly overlap so as to bond or fuse together during the molding process. Alternatively, or in addition to any slight overlapping of edges, one or more portions of seam tape can be provided to bridge the facing edge portions of the mesh material layer 1025 and layers 220, 210, 230 to serve as the material that bonds these layers together. This revised process can reduce steps in the manufacture of the two molded piece cap 1000.

Figure 12C:
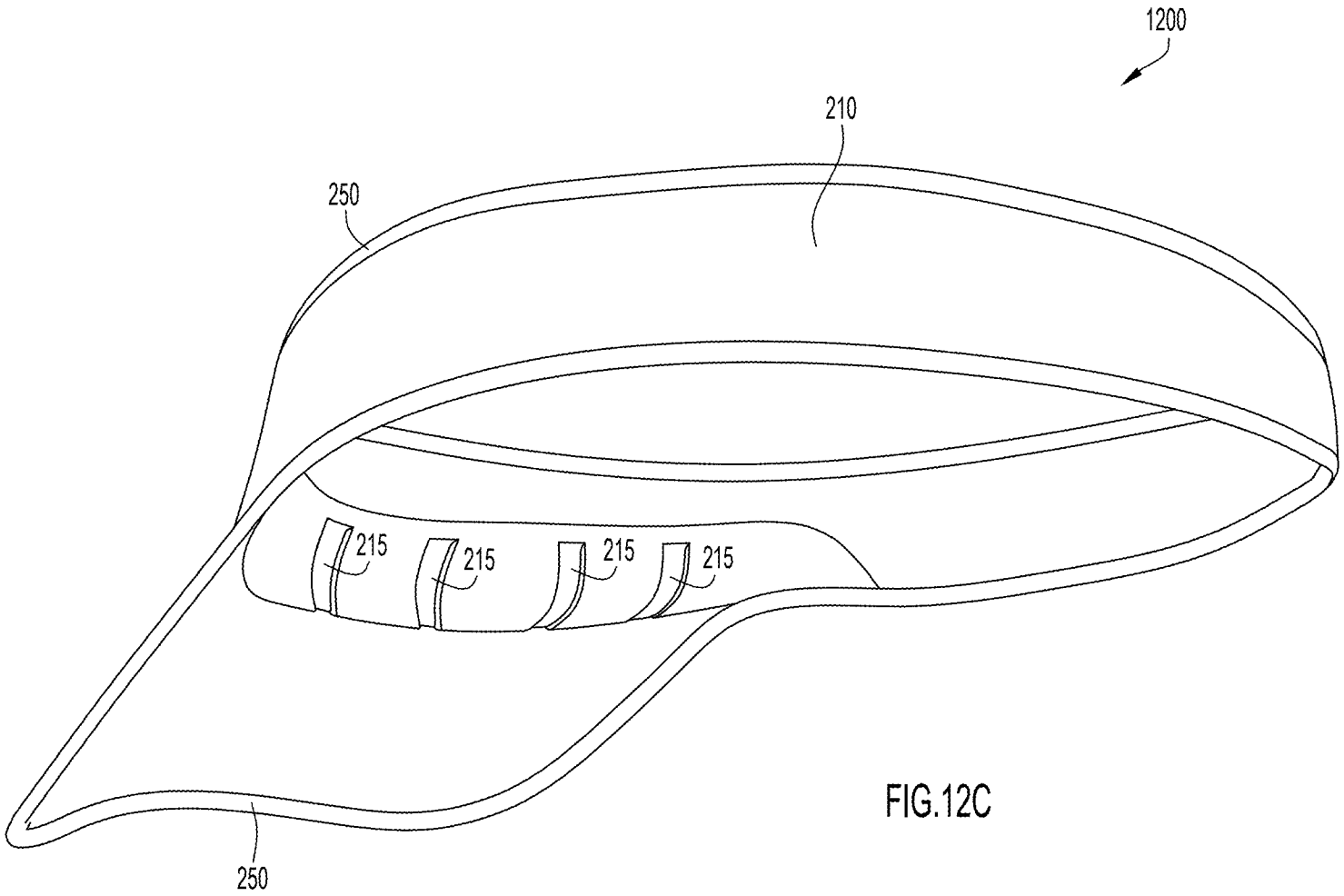
FIG. 12C is a lower side view in perspective of the visor of FIG. 12A showing the inner or forehead facing surface of the crown portion with grooves or channels disposed along such surface.

A further embodiment of headwear including a unitary molded portion extending between brim and crown portion of the headwear is described with reference to FIGS. 12A, 12B and 12C. In this embodiment, the headwear is formed as a visor 1200. In particular, the visor 1200 includes a brim 120 that is substantially similar to the brim 120 of the cap 100 depicted in FIGS. 1-6. The crown portion 1210 of the visor 1200 is also similar to the crown 110 of the cap 100. However, the crown portion 1210 is truncated such that it is open and does not cover a top portion or the crown of a wearer's head. While not shown, the material layers forming the visor 1200 can be similar to the material layers forming cap 100 as shown, e.g., in FIG. 3A, where layers 310 and 320 of the visor 1200 have the same dimensions and shapes as those same layers depicted in FIG. 3A. The layers 210, 220, 230 of the visor 1200 are similar to the intermediate (foam) layer, and upper and lower fabric layers of the cap 100 with the exception that a cut-out or opening in each of these layers would be provided for the visor 1200 (due to the crown portion of the visor only extending partially upward from the brim and thus being open to expose the crown or apex of the wearer's head when worn). The crown portion 1210 extends a sufficient distance from the transition region between crown portion 1210 and the brim 120 so as to achieve the same or similar effects in contouring around the wearer's forehead and reducing or eliminating pressure points as described and depicted for cap 100.

The visor 1200 includes a plurality of linear grooves or channels 1215 (FIG. 12C) formed along the surface of the lower fabric layer 230 along the crown portion 1210 that aligns with and faces toward the forehead of the wearer when the visor is worn. The channels 1215 extend partially into the lower fabric layer 230 and can be formed in a similar manner as the molded grooves 125 during the molding process (i.e., via protrusions or ribs provided at a suitable location along the second shell portion of the mold). The channels 1215 extend vertically along the crown portion 1210 and facilitate airflow at locations between the wearer's forehead and the surrounding environment so as to enhance the cooling features of the visor 1200 during use. Such groove or channels can also be provided on other headwear embodiments and at similar locations (e.g., cap 100) to provide airflow pathways for the headwear when worn.

Figure 14:
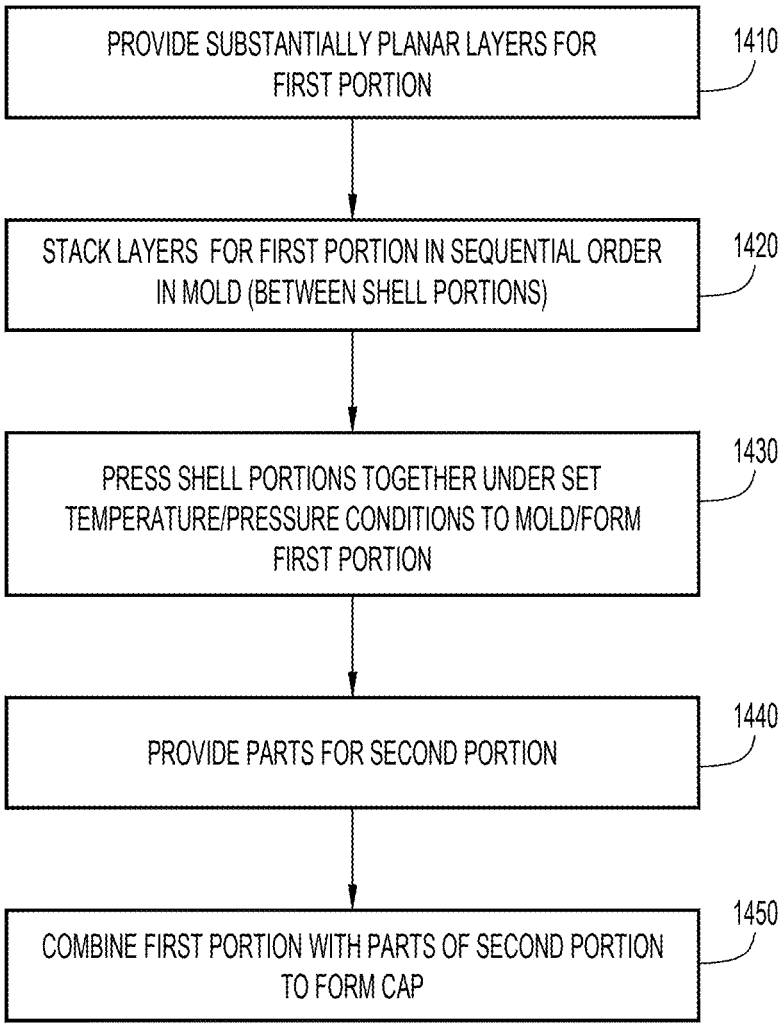
FIG. 14 is a flowchart describing an example process of forming an article of headwear (e.g., the cap of FIG. 13A) by molding a first portion and then combining the first portion with a second portion that comprises a series of shaped parts or segments that are combined together.

Another embodiment of headwear is depicted in the form of a cap 1300 of FIGS. 13A and 13B. The cap 1300 includes a first portion 1305 that is similar to the visor 1200 of FIGS. 12A and 12B, and is further formed in the same or similar molding process as the cap 100 and the visor 1200. A second portion 1320 of the cap 1300 is formed from shaped pieces or shaped segments that are combined with the first portion 1305 to form the cap. A method of forming the headwear or cap 1300 is now described with reference to the flowchart of FIG. 14. The generally planar material layers which form the first portion 1305 are provided (step 1410) having suitable dimensions and shapes and comprise sweatband layer 320, lower fabric layer 230, reinforcement plate 310, intermediate (foam) layer 210, and upper fabric layer 220. In particular, the layers of first portion 1305 are dimensioned in a manner similar as the layers used to form the visor 1200, where each layer 220, 210, 230 extends continuously from the brim 120 around the transition region between brim and crown to a crown portion 1310 that is dimensioned to align with the forehead of a wearer during use of the cap 1300. The layers are stacked sequentially in suitable alignment with each other and between shell portions of a mold (1420), e.g., in a manner similar to how the layers of the visor 1200 are stacked in the same or similar mold. The shell portions of the mold are pressed together (step 1430) under suitable/set temperature and pressure conditions (e.g., similar to those previously described herein when forming cap 100) to mold or form the first portion 1305. Thus, the first portion 1305, without any further processing, has a configuration similar to the visor 1200.

A plurality of material parts or pieces is provided (step 1440) for forming the second portion 1320 of the cap 1300. The parts include a first side member 1322, a second side member 1324, a first mid member 1326, and a second mid member 1328. The parts have pre-formed shapes which be via one or more separate molding processes and/or any other suitable process. The shapes of the parts combine by orienting in suitable alignment with each other to define a dome-shaped configuration that covers and combines with the first portion 1305 thus forming the cap 1300. As shown in FIG. 13B, the first and second side members 1322, 1324 define opposing side sections of the second portion 1320, while the first and second mid members 1326, 1328 combine to define a mid-section of the second portion 1320. Each member has a curved configuration suitable for its positioning such that, when combining the members, a dome shaped second portion 1320 is formed.

The members 1322, 1324, 1326, 1328 of the second portion 1320 are combined (step 1450) with the first portion 1305 to enclose the crown of the cap 1300, where each member can be secured to another member and an upper open edge of the first member 1305 in any suitable manner (e.g., via stitching, sealing tape sections at the interfaces between member/member and/or member/first portion, etc.). Thus, the cap 1300 is formed by molding the first portion including brim and portion of crown that at least partially covers the forehead of a wearer, then combining parts to form a domed second portion that is secured to the first portion. It is noted that any suitable number of parts may be combined to form the second portion that is further combined with the molded first portion to form the cap. For example, the second portion can comprise one part, two parts, three parts, or any suitable number of parts.

Thus, headwear are formed as described herein that can comprise a laminate textile or laminate fabric in the form of a single, unitary molded member or piece. The headwear can also comprise a combination of two molded members or pieces that are secured to each other, or a single molded member or piece secured to other pieces formed in any manner (molded or other). At least one molded portion of the headwear can be formed as a single, unitary molded portion that includes a brim of the headwear and at least a portion of a crown for the headwear that is oriented to align with a forehead portion of the wearer, where two or more layers (e.g., one or more fabric layers and an intermediate layer, such as a foam layer) extend continuously between the brim and at least a portion of the crown.

The fabric laminate or unitary molded member that forms the headwear comprises a plurality of layers and can include any selected number of layers, where different fabric laminates including different types and/or numbers of layers can be provided at different locations of the headwear. For example, some locations of the headwear may include one or more internal structural support members while other locations do not, thus changing the structural configuration of the fabric laminate at different locations of the headwear.

At least one intermediate layer that continuously extends between brim and crown and can further extend substantially the length of the headwear can comprise a foam layer. Alternatively, at least one intermediate layer that continuously extends between brim and crown and can further extend substantially the length of the headwear can comprise a fabric layer. The upper and lower fabric layers forming the exposed surfaces of the headwear also continuously extend between brim and crown and can further extend substantially the length of the headwear. This configuration provides the suitable transition angle at the transition region between brim and crown and further facilitates flexing and conforming to the shape of the wearer's head (including forehead) to minimize or eliminate hard edges or pressure points that might otherwise exist at contact points of the headwear at the transition region and wearer's forehead depending upon a particular size or shape of the wearer's head.

The fabric layers forming portions of the headwear (e.g., upper and lower fabric layers and/or one or more intermediate fabric layers) can be knit, woven, embroidered and/or nonwoven fabric layers and can optionally include fusible and/or non-fusible yarns as described herein to increase stiffness and/or enhance structural integrity of the headwear and its "memory" or shape retention (i.e., ability to revert to and maintain a molded shape even after being deformed by compressive and/or bending forces applied to the headwear).

The headwear embodiments as described herein can further be configured to have heat transfer or heat retention enhancing properties at any one or more layers of the headwear. For example, as previously described herein, the lower fabric layer (and/or any other layer of the headwear) can be imparted with cooling features and/or heat retention features by providing filaments and/or yarns of different shapes and/or additives to the fabric layer that facilitate modification of one or more thermal properties of the fabric layer based upon a change in temperature applied to the fabric layer. Other features, such as grooves or channels along surface portions of the headwear (e.g., the lower fabric layer) and also perforations through portions of the headwear can also be provided, via the molding process, to selective areas or regions of the headwear to enhance airflow between the wearer's head and the surrounding environment during use of the headwear.

The molding process used to form at least a portion of the headwear that is a unitary and seamless member minimizes or eliminates the use of stitching or other seams that can provide hard or rough surfaces or edges that might cause discomfort for a wearer. In addition, certain aesthetic features, such as buttons or stitching seams along portions of the headwear can be artificially created in the form of molded buttons and molded grooves that mimic seam lines by the molding process. Through-holes or eyelets as well as other features can also be formed in the headwear via the molding process.

To summarize, example embodiments of a cap or other headwear as described herein comprise features as noted herein and also as set forth as follows. It is noted that the features as set forth below can be provided in any number of different combinations for the cap or headwear.

In example embodiments, an article of headwear comprises a crown portion dimensioned to cover a portion of a forehead of a wearer when the article of headwear is worn by the wearer, and a brim that extends transversely from the crown portion. The crown portion and the brim are formed of a single unitary molded body comprising an upper fabric layer, a lower fabric layer, and an intermediate layer disposed between the upper fabric layer and the lower fabric layer, and each of the upper fabric layer, the lower fabric layer and the intermediate layer continuously extends between the crown portion and the brim. In addition, a transition angle is defined at a transition between the brim and the crown portion, where the transition angle is obtuse. The transition angle can be at least about 100°, at least about 110°, or at least about 120°, or 130° or even greater.

An arc can be defined in a plane of the brim at the transition between the brim and the crown portion, and a curvature of the arc can change in response to stretching of the brim and/or the crown portion to fit varying sizes of a head of a wearer. The curvature of the arc can be configured to change by at least about 5°, or at least about 10°, or at least about 15°, or at least about 20° or greater.

At least one of the upper fabric layer, the lower fabric layer, and the intermediate layer can comprise a material having an elongation of about 50% to about 75% when aligned in a length direction of the article of headwear. In addition, the material of at least one of the upper fabric layer, the lower fabric layer, and the intermediate layer further can have an elongation of about 90% to about 120% when aligned in a direction that is transverse the length direction of the article of headwear. Further, the material of at least one of the upper fabric layer, the lower fabric layer, and the intermediate layer can have a recovery when aligned in one or both of the length direction and the direction that is transverse the length direction that is greater than about 80%.

The intermediate layer can comprise a foam layer.

At least one fabric layer can extend continuously between the crown portion and the brim and include fusible yarns having a glass transition temperature no greater than about 150° C., the fusible yarns being fused with other yarns crossing the fusible yarns within the at least one fabric layer.

An exposed surface of one or both the upper fabric layer and the lower fabric layer can include one or more raised protrusions and/or one or more grooves disposed at one or more locations along the exposed surface that were formed during molding of the article of headwear. The exposed surface of the upper fabric layer can include a raised protrusion along the crown portion that is shaped to resemble a button. The exposed surface of the upper fabric layer can include a plurality of grooves along the brim that are shaped to resemble stitch lines.

The lower fabric layer can include one or more components that modify a thermal property of the lower fabric layer based upon changes in temperature applied to the lower fabric layer. The lower fabric layer can possess a Qmax rating of at least 0.1 $W/m^2$.

The lower fabric layer can comprise particles selected from the group consisting of titanium dioxide, jade, mica, graphene, and any combination thereof.

The lower fabric layer can comprise polyester filaments embedded with mica, where the polyester filaments possess an undulated cross-section.

The article of headwear can possess a breathability of at least about 300 CFM.

In other example embodiments, an article of headwear comprises a crown portion dimensioned to cover a portion of a forehead of a wearer when the article of headwear is worn by the wearer, and a brim that extends transversely from the crown. The crown portion and the brim are formed of a single unitary molded body comprising an upper fabric layer, a lower fabric layer, and an intermediate layer disposed between the upper fabric layer and the lower fabric layer, and each of the upper fabric layer, the lower fabric layer and the intermediate layer continuously extends between the crown and the brim. The brim further includes a reinforcement member extending within the brim between the upper fabric layer and the lower fabric layer.

The reinforcement member can be located between the intermediate layer and the lower fabric layer.

The intermediate layer can comprise a foam material.

The reinforcement member can have a hardness durometer value that is greater than each of the upper fabric layer, the lower fabric layer and the intermediate layer. In addition, the reinforcement member can extend within the brim so as to terminate at or before a transition region between the brim and the crown. Alternatively, the reinforcement member can extend within the brim, along and beyond a transition region between the brim and the crown.

The brim and/or the crown can include one or more perforations extending therethrough.

A binding material can be provided along outer perimeter edge portions of the upper fabric layer, the intermediate layer and the lower fabric layer. The binding material can be folded over the outer perimeter edge portions.

A sweatband layer can be provided that extends over an exposed portion of the lower fabric layer. The sweatband layer can extend over the exposed portion of the lower fabric layer and along a transition region between the brim and the crown.

A transition angle can be defined at a transition between the brim and the crown portion, and the transition angle can be obtuse. The transition angle can be at least about 100°, at least about 110°, or at least about 120°, or 130° or even greater.

An arc can be defined in a plane of the brim at the transition between the brim and the crown portion, and a curvature of the arc can change in response to stretching of the brim and/or the crown portion to fit varying sizes of a head of a wearer. The curvature of the arc can be configured to change by at least about 5°, or at least about 10°, or at least about 15°, or at least about 20° or greater.

An exposed surface of one or both the upper fabric layer and the lower fabric layer can include one or more molded protrusions and/or one or more molded grooves disposed at one or more locations along the exposed surface. For example, a molded button can be located along the crown portion, where the molded button is defined by corresponding convex shaped portions of each of the upper fabric layer, the intermediate layer and the lower fabric layer at an exposed exterior surface portion and an exposed interior surface portion of the crown. In addition, the exposed interior surface portion of the lower fabric layer can have a concave shape at the molded button.

The lower fabric layer can include one or more components that modify a thermal property of the lower fabric layer based upon changes in temperature applied to the lower fabric layer.

In further example embodiments, an article of headwear comprises a crown portion dimensioned to cover a portion of a forehead of a wearer when the article of headwear is worn by the wearer, a brim that extends transversely from the crown, and a molded button having a raised three dimensional shape defined at an exposed exterior surface portion of the crown.

The molded button can be defined at an apex of the crown. The molded button can also have a hemispherical three dimensional shape.

The crown can include a depression at an exposed interior surface portion of the crown corresponding with the raised three dimension shape defined at the exposed exterior surface portion of the crown.

The crown portion and the brim can be formed of a single unitary molded body comprising an upper fabric layer that includes the exposed exterior surface portion of the crown, a lower fabric layer that includes the exposed interior surface portion of the crown, and an intermediate layer disposed between the upper fabric layer and the lower fabric layer, and each of the upper fabric layer, the lower fabric layer and the intermediate layer can continuously extend between the crown and the brim.

The molded button can further be defined by corresponding convex shaped portions of each of the upper fabric layer, the intermediate layer and the lower fabric layer at the exposed exterior surface portion and the exposed interior surface portion of the crown. In addition, the exposed interior surface portion of the lower fabric layer can have a concave shape at the molded button.

A plurality of molded grooves can extend along exposed exterior surface portions of the upper fabric layer at the brim.

A plurality of molded ridges can extend along further exposed exterior surface portions of the upper fabric layer at the crown.

In additional embodiments, an article of headwear comprises a crown portion dimensioned to cover a portion of a forehead of a wearer when the article of headwear is worn by the wearer, and a brim that extends transversely from the crown, where the crown portion and the brim are formed of a single unitary molded body comprising an upper fabric layer, a lower fabric layer, and an intermediate layer disposed between the upper fabric layer and the lower fabric layer, and each of the upper fabric layer, the lower fabric layer and the intermediate layer continuously extends between the crown and the brim. At least one molded feature formed as a depression and/or a protrusion along an exposed surface of the brim and/or the crown.

At least one molded feature can comprise a molded button located at along the crown. The molded button can have a hemispherical shape defined by a convex shaped portion of the upper fabric layer. Each of the intermediate layer and the lower fabric layer can include a convex shaped portion that corresponds with the convex shaped portion of the upper fabric layer. The lower fabric layer can include an exposed concave surface that corresponds with the convex shaped portion of the upper fabric layer.

The at least one molded feature can comprise a plurality of molded grooves formed within an exposed surface portion of the upper fabric layer at the brim. Each of the molded grooves can have a U-shape. The molded grooves can be consecutively aligned in a nested pattern.

The at least one molded feature can comprise a plurality of molded ridges formed along exposed surface portion of the upper fabric layer at the crown.

In still further example embodiments, an article of headwear comprises a molded crown portion, and a molded brim portion including a textile layer, a foam layer, and a structural element having a radius of curvature facing a head of a wearer. The structural element is disposed between the foam layer and the textile layer, and the structural element is further dynamic such that the radius of curvature changes under load, thereby adapting to a curvature of the forehead of the wearer.

The brim portion can transition to a crown portion at a transition region, the radius of curvature being positioned outside of the transition region.

The brim portion can comprise the textile layer and the foam layer, and the crown portion and brim portion can form a unitary molded body.

The crown portion can be an open crown containing an opening proximate an apex of the crown. Alternatively, the crown portion can be a closed crown.

In an embodiment of the article of footwear, the textile layer is a first textile layer, the foam layer is a first foam layer, the brim portion comprises the first textile layer, the first foam layer, the structural element, a second textile, and a second foam layer. The structural element can be a resilient, non-foamed panel capable of in-plane and out-of-plane flexure. In addition, the structure element can comprise an array of openings. Upon compression, the foam can extend through one or more of the openings of the structural element.

The structural element can be an injection molded plastic panel.

The article of headwear can further comprise a compression molded texture into brim portion and/or compression molded texture into the crown portion.

In still further example embodiments, a method of forming an article of headwear comprises placing a plurality of layers in stacked orientation within a mold, where the plurality of layers comprises a lower fabric layer, an intermediate layer, and an upper fabric layer, and pressing the plurality of layers together within the mold to form a unitary molded member comprising the layers, the unitary molded member having a three-dimensional shape. The unitary molded member defines a crown portion dimensioned to cover a portion of a forehead of a wearer when the article of headwear is worn by the wearer, and a brim that extends transversely from the crown portion, and each layer of the plurality of layers extends between the brim and the crown portion.

The plurality of layers can be placed in the stacked orientation such that at least one of the upper fabric layer, the lower fabric layer, and the intermediate layer has an elongation of about 50% to about 75% in a direction of the mold that corresponds with a length direction of the article of headwear, the length direction of the article of headwear extending from brim to crown portion.

The plurality of layers can also be placed in the stacked orientation such that at least one of the upper fabric layer, the lower fabric layer, and the intermediate layer has an elongation of about 90% to about 120% in a direction of the mold that corresponds with a direction that is transverse the length direction of the article of headwear.

The at least one of the upper fabric layer, the lower fabric layer, and the intermediate layer can have a recovery, when aligned in one or both of the length direction of the article of headwear and the direction, that is transverse the length direction of the article of headwear that is greater than about 80%.

The intermediate layer can comprise a reinforcement plate comprising a material having a hardness that is greater than each of the upper fabric layer and the lower fabric layer. After pressing the plurality of layers together within the mold, the reinforcement plate can extend within the unitary molded member so as to continuously extend from the brim to the crown portion and around a transition region defined between the brim and the crown portion.

The reinforcement plate can include a plurality of through-holes extending through the reinforcement plate.

The placing the plurality of layers in stacked orientation within the mold can further comprise placing a foam layer between the upper fabric layer and the reinforcement plate or between the lower fabric layer and the reinforcement plate. The pressing the plurality of layers together within the mold to form the unitary member can include forcing portions of the foam layer against the reinforcement plate such that portions of the foam layer extend into and/or through the through-holes of the reinforcement plate.

The intermediate layer can comprise a foam layer. Each of the upper fabric layer, the lower fabric layer and the foam layer can extend substantially an entire length of the unitary member.

Each layer of the plurality of layers can have a planar shape when placed in stacked orientation within the mold.

The crown portion can be closed to define a dome shaped member that covers a wearer's head.

Alternatively, the crown portion can be open so as to cover only a portion of a wearer's head, and the method can further comprise combining the crown portion of the unitary member with a second crown portion so as to form a crown that is closed to cover the wearer's head. The second crown portion can comprise a mesh material. The second crown portion can alternatively comprise a plurality of segments combined to form the second crown portion.

While the invention has been described in detail and with reference to specific embodiments thereof, it will be apparent to one skilled in the art that various changes and modifications can be made therein without departing from the spirit and scope thereof.

It is therefore intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. An article of headwear comprising:

a crown portion dimensioned to cover a portion of a forehead of a wearer when the article of headwear is worn by the wearer;

a brim that extends transversely from the crown portion; and a crown button protruding from the crown portion;

wherein:

the crown portion and the brim comprise a single unitary molded body including an upper fabric layer, a lower fabric layer, and an intermediate layer disposed between the upper fabric layer and the lower fabric layer;

each of the upper fabric layer, the lower fabric layer and the intermediate layer continuously extends between the crown portion and the brim such that the upper fabric layer, the lower fabric layer and the intermediate layer are within at least a portion of each of the crown portion and the brim;

the crown button comprises a protruding area along an exposed side of the upper fabric layer and a recessed area along an exposed side of the lower fabric layer that directly underlies and corresponds with the protruding area along the exposed side of the upper fabric layer; and a transition angle is defined at a transition between the brim and the crown portion, wherein the transition angle is obtuse.

2. The article of headwear of claim 1, wherein the transition angle is at least 100°, at least 110°, or at least 120°, or 130° or even greater.

3. The article of headwear of claim 1, wherein an arc is defined in a plane of the brim at the transition between the brim and the crown portion, and a curvature of the arc changes within the plane of the brim in response to stretching of the brim and/or the crown portion to fit varying sizes of a head of a wearer.

4. The article of headwear of claim 3, wherein the curvature of the arc is configured to change by at least 5°, or at least 10°, or at least 15°, or at least 20° or greater.

5. The article of headwear of claim 1, wherein at least one of the upper fabric layer and the lower fabric layer comprises a material having an elongation of 50% to 75% when aligned in a length direction of the article of headwear.

6. The article of headwear of claim 5, wherein the material of the at least one of the upper fabric layer and the lower fabric layer has an elongation of 90% to 120% when aligned in a direction that is transverse the length direction of the article of headwear.

7. The article of headwear of claim 6, wherein the material of at least one of the upper fabric layer and the lower fabric layer has a recovery when aligned in one or both of the length direction and the direction that is transverse the length direction that is greater than 80%.

8. The article of headwear of claim 1, wherein the intermediate layer comprises a foam layer.

9. An article of headwear comprising:

a crown portion dimensioned to cover a portion of a forehead of a wearer when the article of headwear is worn by the wearer; and a brim that extends transversely from the crown portion;

wherein:

the crown portion and the brim comprise a single unitary molded body including an upper fabric layer, a lower fabric layer, and an intermediate layer disposed between the upper fabric layer and the lower fabric layer;

each of the upper fabric layer, the lower fabric layer and the intermediate layer continuously extends between the crown portion and the brim such that the upper fabric layer, the lower fabric layer and the intermediate layer are within at least a portion of each of the crown portion and the brim;

the upper fabric layer includes a plurality of molded grooves within the brim; and a transition angle is defined at a transition between the brim and the crown portion, wherein the transition angle is obtuse.

10. The article of headwear of claim 1, wherein the lower fabric layer includes one or more components that modify a thermal property of the lower fabric layer based upon changes in temperature applied to the lower fabric layer.

11. The article of headwear of claim 10, wherein the lower fabric layer possesses a Qmax rating of at least 0.1 $W/m^2$.

12. The article of headwear of claim 10, wherein the lower fabric layer comprises particles selected from the group consisting of titanium dioxide, jade, mica, graphene, and any combination thereof.

13. The article of headwear of claim 10, wherein the lower fabric layer further comprises polyester filaments embedded with mica, wherein the polyester filaments possess an undulated cross-section.

14. The article of headwear of claim 9, wherein each molded groove of the plurality of molded grooves extends continuously to form an arc.

15. An article of headwear comprising a one-piece molded body, the one-piece molded body including:

a crown;

a brim extending transversely from the crown to define a transition angle between the crown and the brim; and a crown button protruding from the crown;

wherein:

the one-piece molded body comprises fused layers including a first fabric layer, an intermediate foam layer, and a second fabric layer;

each of the first fabric layer, the second fabric layer, and the intermediate foam layer extends continuously from the crown button to the brim;

each of the first fabric layer, the second fabric layer, and the intermediate foam layer further extends continuously from the transition angle to a terminal edge of the brim; and the brim includes a molded and stitchless groove.

16. The article of headwear of claim 15, wherein the crown button comprises a protruding area along an exterior side of the one-piece molded body and a recessed area along an interior side of the one-piece molded body.

17. The article of headwear of claim 16, wherein the crown further comprises a molded crease extending from the crown button.

18. The article of headwear of claim 15, wherein the first fabric layer comprises a knit fabric or a woven fabric.

19. The article of headwear of claim 18, wherein the second fabric layer comprises a knit fabric or a woven fabric.

* * * * *